US005562083A

United States Patent [19]

Osanai

[11] Patent Number: 5,562,083

[45] Date of Patent: Oct. 8, 1996

[54] FUEL VAPOR EMISSION CONTROL DEVICE FOR ENGINE

[75] Inventor: Akinori Osanai, Susono, Japan

[73] Assignee: Toyota Jidosha Kabushiki Kaisha, Japan

[21] Appl. No.: 569,680

[22] Filed: Dec. 8, 1995

[30] Foreign Application Priority Data

Mar. 3, 1995 [JP] Japan ..... 7-044310

[51] Int. Cl.[6] ..... F02M 25/08

[52] U.S. Cl. ..... 123/519; 123/520

[58] Field of Search ..... 123/516, 518, 123/519, 520, 521

[56] References Cited

U.S. PATENT DOCUMENTS

| | | | |
|---|---|---|---|
| 5,056,494 | 10/1991 | Kayanuma | 123/519 |
| 5,170,765 | 12/1992 | Hoshino et al. | 123/519 |
| 5,245,973 | 9/1993 | Otsuka et al. | 123/518 |
| 5,355,861 | 10/1994 | Arai | 123/519 |
| 5,359,978 | 11/1994 | Kidokoro et al. | 123/520 |
| 5,398,660 | 3/1995 | Koyama et al. | 123/519 |
| 5,456,236 | 10/1995 | Wakashiro | 123/519 |
| 5,456,237 | 10/1995 | Yamazaki et al. | 123/520 |
| 5,460,136 | 10/1995 | Yamazaki et al. | 123/520 |
| 5,477,836 | 12/1995 | Hyodo et al. | 123/520 |
| 5,487,369 | 1/1996 | Hara et al. | 123/520 |

FOREIGN PATENT DOCUMENTS

| | | |
|---|---|---|
| 61-53451 | 3/1986 | Japan . |
| 5-86997 | 4/1993 | Japan . |

*Primary Examiner*—Thomas N. Moulis
*Attorney, Agent, or Firm*—Kenyon & Kenyon

[57] ABSTRACT

A fuel emission control device for an engine comprises an adsorbent for temporarily adsorbing fuel vapor therein. A canister for housing the adsorbent therein is connected to a fuel tank via a fuel vapor passage, through which fuel vapor in the fuel tank is introduced into the canister. The canister is also connected to an intake passage downstream of a throttle valve via a purge passage, through which fuel vapor adsorbed in the adsorbent is purged into the intake passage. When an amount of fuel vapor to be introduced to the canister becomes larger, the effective volume of the adsorbent interposed between the fuel vapor passage and the purge passage is made larger.

34 Claims, 17 Drawing Sheets

FUEL VAPOR EMISSION CONTROL DEVICE FOR ENGINE

BACKGROUND OF THE INVENTION

1. Field of the Invention

The present invention relates to a fuel vapor emission control device for an engine.

2. Description of the Related Art

In a general engine for, for example, a motor vehicle, fuel in a fuel tank is supplied by a fuel pump to a fuel injector, and is fed into the engine by the fuel injector. When the fuel consumption is small, such as in an idling operation of the engine, a surplus of fuel fed to the injector is returned to the fuel tank. When the surplus is flowing through piping, it may be heated by high temperature parts, such as a cylinder head of the engine around the piping, and thus, fuel of high temperature may be returned to the fuel tank. On the other hand, the temperature of fuel in the fuel tank is also increased by ambient temperature when the engine is stopped, if the ambient temperature is high. If the temperature of the fuel in the fuel tank is increased, a large amount of fuel vapor may be generated in the fuel tank to thereby increase the pressure in the fuel tank. At this state, the fuel tank may deform. To reduce the pressure in the fuel tank, the fuel vapor is discharged out of the fuel tank.

However, it is not desirable to discharge fuel vapor into the outside air. To prevent the fuel vapor from escaping to the outside air, motor vehicles have been provided with an adsorbing layer made of, for example, activated charcoal to trap fuel vapor therein. Fuel vapor adsorbed in the activated charcoal is released by air passing through the activated charcoal. The released fuel component and air are fed into an intake passage of the engine and are burned in a combustion chamber together with injected fuel.

Such a kind of fuel vapor emission control device is disclosed in, for example, Japanese Unexamined Patent publication No. 61-53451. In JPP '451, all of fuel vapor generated in the fuel tank is, first, introduced into the activated charcoal layer. After being temporarily adsorbed in the layer, the fuel vapor is purged into the intake passage of the engine, to prevent the amount of fuel vapor purged into the intake passage of the engine becoming too large, so that the fluctuation in the air-fuel ratio during the purging operation becomes smaller.

The activated charcoal used for the adsorbent deteriorates after repeated adsorption and release of fuel vapor. Therefore, if a large amount of fuel vapor from the fuel tank is always introduced into the activated charcoal, as in the device mentioned above, the activated charcoal rapidly deteriorates. If the activated charcoal deteriorates, fuel vapor is purged into the intake passage without temporarily being adsorbed in the activated charcoal. A problem occurs that the large amount of fuel vapor may be purged into the intake passage of the engine, and thereby, it causes an undesirable wide fluctuation in the air-fuel ratio.

SUMMARY OF THE INVENTION

An object of the present invention is to provide a fuel vapor emission control device capable of reducing the deterioration of the adsorbent, while preventing the air-fuel ratio from widely fluctuating during the purging operation.

According to the present invention, there is provided a fuel vapor emission control device for an engine having a fuel tank and an intake passage with a throttle valve, the device comprising: an adsorbent for temporarily adsorbing fuel vapor therein, the adsorbent being housed in a canister; a fuel vapor passage connecting the fuel tank to the canister for introducing fuel vapor in the fuel tank to the canister; a purge passage connecting the canister to the intake passage downstream of the throttle valve for purging fuel vapor adsorbed in the adsorbent into the intake passage; purge control means for controlling a purging operation in which fuel vapor in the adsorbent is purged into the intake passage via the purge passage; and effective volume control means for controlling an effective volume of the adsorbent interposed between the fuel vapor passage and the purge passage, during the purging operation, to become larger when an amount of fuel vapor to be introduced from the fuel tank to the canister becomes larger.

The present invention may be more fully understood from the description of preferred embodiments of the invention set forth below, together with the accompanying drawings.

DESCRIPTION OF THE PREFERRED EMBODIMENTS

Figure 1:
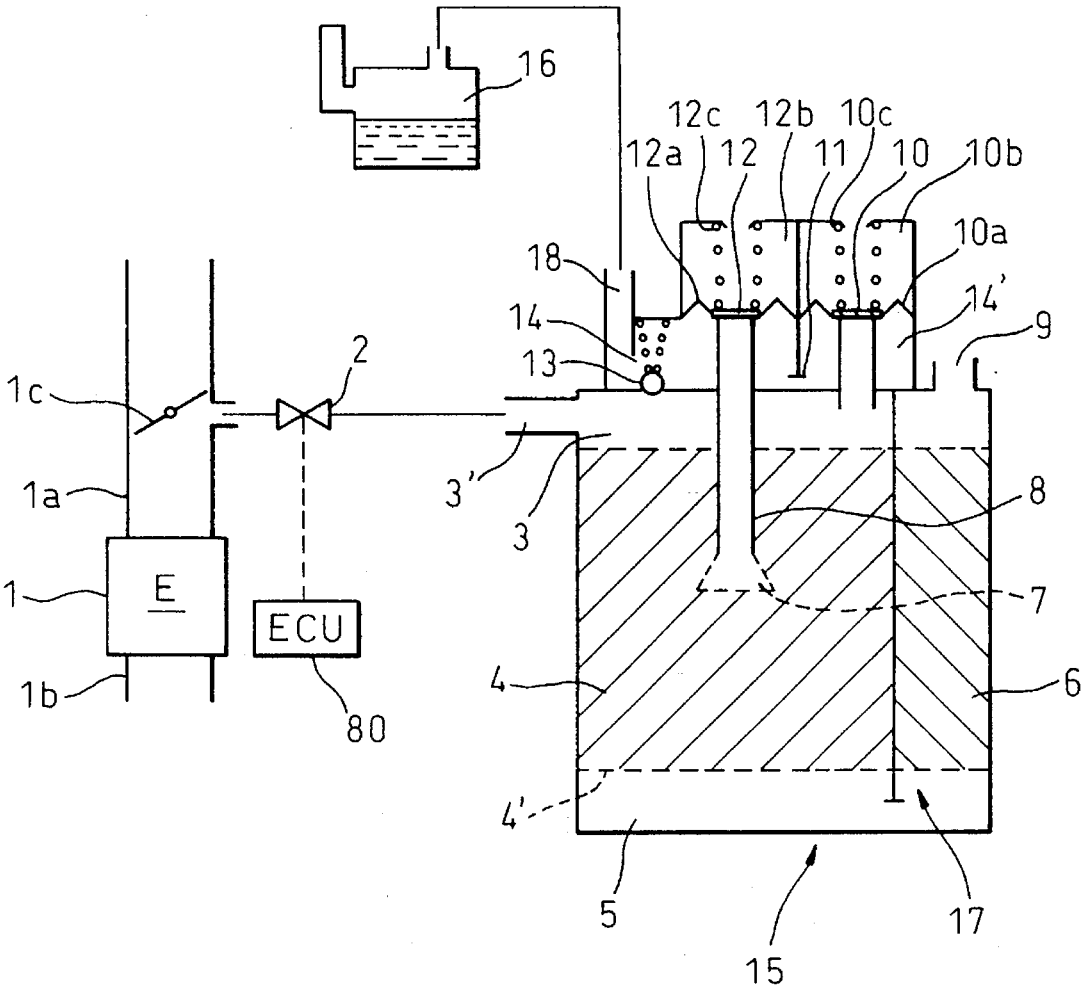
FIG. 1 shows a fuel vapor emission control device for an engine, according to the first embodiment of the present invention.

Embodiments according to the present invention will be explained in detail with reference to drawings. In the drawings, similar components are denoted by the same reference numerals throughout the drawings.

FIG. 1 shows a fuel vapor emission control device for an engine according to a first embodiment of the present invention. Referring to FIG. 1, an engine 1 is connected to an intake passage 1*a* and to an exhaust passage 1*b*. The intake passage 1*a* has a throttle valve 1*c* arranged therein. Between the intake passage 1*a* downstream of the throttle valve 1*c* and a fuel tank 16 of the engine, a canister 15 is interposed. The canister 15 is connected to the intake passage 1*a* via a purge passage 3', and to the fuel tank 16 via a fuel vapor passage 18. The purge passage 3' has a purge control valve 2 arranged therein, for controlling an amount of a purge gas passing therethrough. The purge control valve 2 is controlled by signals output from an electronic control unit (ECU) 80, which is constructed as shown in, for example, FIG. 9. Alternatively, the purge control valve 2 may be a vacuum-driven type valve.

The canister 15 has an adsorbing layer 4' having an adsorbent 4 made of activated charcoal. The canister 15 further has a fuel vapor diffusion chamber 3 formed on one side of the adsorbing layer 4', an air chamber 5 formed on another side of the adsorbing layer 4', and an air inlet 9 open to the atmosphere. The air chamber 5 and the inlet 9 are connected to each other via a buffer 17 provided in the canister 15. The buffer 17 has an additional adsorbent 6 made of activated charcoal to prevent fuel vapor from escaping to the atmosphere, which fuel vapor reaches the air chamber 5, without being adsorbed in the adsorbent 4, when a purging operation is stopped.

The canister 15 furthermore has a first fuel vapor chamber 14 and a second fuel vapor chamber 14', which are connected to each other via a choke 11. The first fuel vapor chamber 14 is connected to the fuel tank 16 via the fuel vapor passage 18, and to the adsorbing layer 4' via a first pressure control valve 12 and via a fuel vapor guide 8. The first pressure control valve 12 is connected to a diaphragm 12*a* fixed to the canister 15. The diaphragm 12*a* defines a diaphragm chamber 12*b* separate from the first fuel vapor chamber 14. The first pressure control valve 12 is arranged at one end of the fuel vapor guide 8, which acts as a fuel vapor inlet, and is biased toward a closed position thereof by a spring 12*c* arranged in the diaphragm chamber 12*b*. Another end 7 of the fuel vapor guide 8, which acts as a fuel vapor outlet, is positioned at a substantially central portion of the adsorbing layer 4'.

The second fuel vapor chamber 14' is connected to the fuel vapor diffusion chamber 3 via a second pressure control valve 10. The second pressure control valve 10 is connected to a diaphragm 10*a* fixed to the canister 15. The diaphragm 10*a* defines a diaphragm chamber 10*b* separate from the second fuel vapor chamber 14'. The second pressure control valve 10 is biased toward a closed position thereof by a spring 10*c* arranged in the diaphragm chamber 10*b*. Both of the diaphragm chambers 12*a* and 12*b* are open to the atmosphere.

The valve opening pressures at which the first and the second pressure control valves respectively open are defined by the biasing forces of the corresponding spring 10*c* and 12*c*. In the embodiment shown in FIG. 1, the valve opening pressure of the first pressure control valve 12 is set higher than that of the second pressure control valve 10.

The fuel vapor diffusion chamber 3 is connected to the first fuel vapor chamber 14 via a fuel vapor return valve 13. The valve 13 controls an amount of fuel vapor returning from the fuel vapor diffusion chamber 3 to the first fuel vapor chamber 14. The valve 13 opens only when the pressure in the first fuel vapor chamber 14 drops below that in the fuel vapor diffusion chamber 3.

When the purge control valve 2 is opened, a negative pressure generated in the intake passage 1*a* downstream of the throttle valve 1*c* draws air into the canister 15. The air enters the buffer 17 via the inlet 9, and flows into, in turn, the air chamber 5 and the adsorbing layer 4'. The air passes through the adsorbing layer 4' and desorbs fuel vapor therefrom. The desorbed fuel vapor and air, i.e., a purge gas then enters the fuel vapor diffusion chamber 3 and is purged to the intake passage 1*a* via the purge passage 3'. In this way, a purging operation is carried out.

Contrarily, when the purge control valve 2 is closed, fuel vapor generated in the fuel tank 16 is introduced into the canister 15 and is adsorbed in the adsorbing layer 4' and/or the additional adsorbing layer 6. Therefore, fuel vapor is prevented from being discharged into the outside air.

Fuel vapor generated in the fuel tank 16 during the purging operation flows through the fuel vapor passage 18 into the first fuel vapor chamber 14. The fuel vapor in the first fuel vapor chamber 14 flows into the second fuel vapor chamber 14' through the choke 11. When the pressure in the second fuel vapor chamber 14' reaches the valve opening pressure of the second pressure control valve 10, the diaphragm 10*a* deforms to open the valve 10. As a result, fuel vapor in the second fuel vapor chamber 14' flows into the fuel vapor diffusion chamber 3.

Since the valve opening pressure of the first pressure control valve 12 is higher than that of the second pressure control valve 10 as mentioned above, the valve 12 is kept closed when the pressure in the first fuel vapor chamber 14 is not sufficiently high. When the pressure in the first fuel vapor chamber 14 is relatively low, i.e., when the amount of the fuel vapor introduced from the fuel tank 16 into the canister 15 is relatively small, fuel vapor is purged into the intake passage 1*a* without passing through the adsorbing layer 4'. Namely, the effective volume of the adsorbing layer 4' interposed between the fuel tank 16 and the intake passage 1*a* is zero when the amount of fuel vapor introduced from the fuel tank 16 to the canister 15 is relatively small. This means that the adsorbing operation in the adsorbing layer 4' is not carried out when the amount of the fuel vapor introduced into the canister 15 is relatively small. Accordingly, the deterioration of the adsorbing layer 4' is moderated.

When the amount of fuel vapor introduced from the fuel tank 16 into the canister 15 is small, a fluctuation in the amount of fuel vapor purged into the intake passage 1*a* will affect the air-fuel ratio of the engine 1 to no, or only a small degree. Namely, in this state, the undesired wide fluctuation in the air-fuel ratio is prevented. Note that the first and second fuel vapor chambers 14 and 14' are connected to each other via the choke 11, which produces a flow resistance against fuel vapor. Accordingly, the amount of fuel vapor passing through the second pressure control valve 10 will not be excessive, when the valve 10 is opened.

Fuel vapor in the second fuel vapor chamber 14' is introduced into the fuel vapor diffusion chamber 3 at the farthest position of the chamber 3 from the purge passage 3'. Accordingly, fuel vapor introduced into the fuel vapor diffusion chamber 3 via the valve 10 is sufficiently mixed with air entering into the fuel vapor diffusion chamber 3 through the adsorbing layer 4', to thereby prevent air fed into the engine from including a portion which contains too much fuel vapor.

When the amount of fuel vapor generated in the fuel tank 16 increases to thereby increase the pressure in the first fuel vapor chamber 14 to the valve opening pressure of the first pressure control valve 12, the diaphragm 12*a* deforms to open the valve 12. As can be seen in FIG. 1, the first fuel vapor chamber 14 is positioned upstream, regarding the fuel vapor flow, of the second fuel vapor chamber 14'. As a result, almost all of the fuel vapor introduced into the canister 15 is introduced from the first fuel vapor chamber 14 to the central portion of the adsorbing layer 4', via the fuel vapor guide 8. The fuel vapor is then adsorbed in the adsorbing layer 4'. Fuel vapor adsorbed in the adsorbing layer 4' is gradually released therefrom by air passing through the adsorbing layer 4' and is purged into the intake passage 1*a* via the fuel vapor diffusion chamber 3. In this state, the adsorbing layer 4' interposed between the fuel tank 16 and the intake passage 1*a* is substantially above the end 7 of the fuel vapor guide 8. Namely, the effective volume of the adsorbing layer 4' is substantially half the total volume of the adsorbing layer 4'. In this way, the effective volume of the adsorbing layer 4' interposed between the fuel tank 16 and the intake passage 1*a* becomes larger, when the amount of fuel vapor introduced from the fuel tank 16 into the canister 15 becomes larger.

As explained above, fuel vapor introduced into the adsorbing layer 4' is adsorbed therein, and is then gradually released therefrom and purged into the intake passage 1*a*. Accordingly, increasing the effective volume of the adsorbing layer 4' between the fuel tank 16 and the intake passage 1*a* prevents a drastic change in the amount of fuel vapor purged into the intake passage 1*a*. Also, a fluctuation in the amount of the fuel vapor purged into the intake passage 1*a* is suppressed. As a result, an undesired wide fluctuation in the air-fuel ratio of the engine is prevented during the purging operation.

According to the first embodiment, the first pressure control valve 12 is connected to the diaphragm 12*a*, which defines the first fuel vapor chamber 14 separate from the diaphragm chamber 12*b*, and the second pressure control valve 10 is connected to the diaphragm 10*a*, which defines the second fuel vapor chamber 14' separate from the diaphragm chamber 10*b*. The diaphragm chambers 12*b* and 10*b* are open to the atmosphere, and therefore, the valve opening pressures of the first and second pressure control valves 12 and 10 are substantially not influenced by an engine operating condition. Namely, the valves 12 and 10 may be opened and closed regardless the engine operating condition. Note that the amount of fuel vapor purged into the intake passage 1*a* is controlled by controlling the purge control valve 2.

Figure 2:
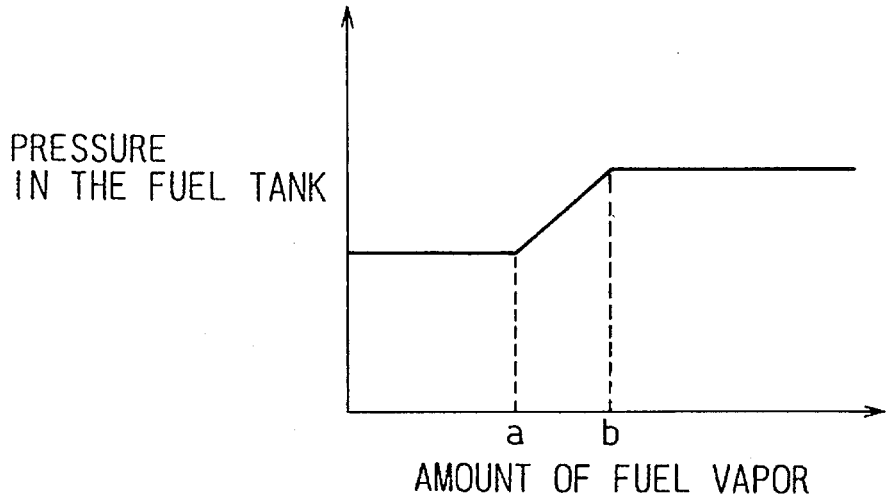
FIG. 2 shows relationships between the amount of fuel vapor generated in a fuel tank and the pressure in the fuel tank.

FIG. 2 shows a relationship between the amount of fuel vapor (at nearly the temperature of the fuel) generated in the fuel tank 16 and the pressure in the fuel tank 16. In a region up to a point "a" in FIG. 2 where the amount of fuel vapor is small, the second pressure control valve 10 works, and thereby the pressure in the fuel tank 16 is kept substantially constant. When the amount of fuel vapor increases above a point "b," the first pressure control valve 12 works, while the second valve 10 is kept open, and thereby the pressure in the fuel tank 16 is kept substantially constant. Namely, when the amount of fuel vapor is small, fuel vapor generated in the fuel tank 16 is directly fed to the fuel vapor diffusion chamber 3. And, when the amount of fuel vapor is large, fuel vapor is fed to the central portion of the adsorbing layer 4' through the fuel vapor guide 8.

When the amount of fuel vapor introduced from the fuel tank 16 into the canister 15 becomes larger, the pressures in the first and second fuel vapor chambers 14 and 14' become higher. The first embodiment opens and closes the first and second pressure control valves 12 and 10 in response to the pressures in the first and second fuel vapor chambers 14 and 14'. Namely, the first embodiment changes the effective volume of the adsorbing layer 4' interposed between the fuel tank 16 and the intake passage 1*a* in response to the amount of fuel vapor introduced from the fuel tank 16 into the canister 15.

When the engine is stopped, the amount of fuel vapor introduced from the fuel tank 16 into the canister 15 is relatively small. Accordingly, the first pressure control valve 12 does not open. During the stoppage of the engine, the fuel vapor introduced into the canister 15 is introduced into the fuel vapor diffusion chamber 3 via the second pressure control valve 10. At this time, the purge control valve 2 is closed to stop the purging operation. Thus, fuel vapor in the second fuel vapor chamber 14' is fed to an end surface of the adsorbing layer 4' and not into the central portion thereof. Therefore, the fuel vapor fed to the fuel vapor diffusion chamber 3 is uniformly adsorbed in the entire of the adsorbing layer 4'. Accordingly, the adsorbing layer 4' is effectively used to adsorb fuel vapor during the stoppage of the engine.

Figure 3:
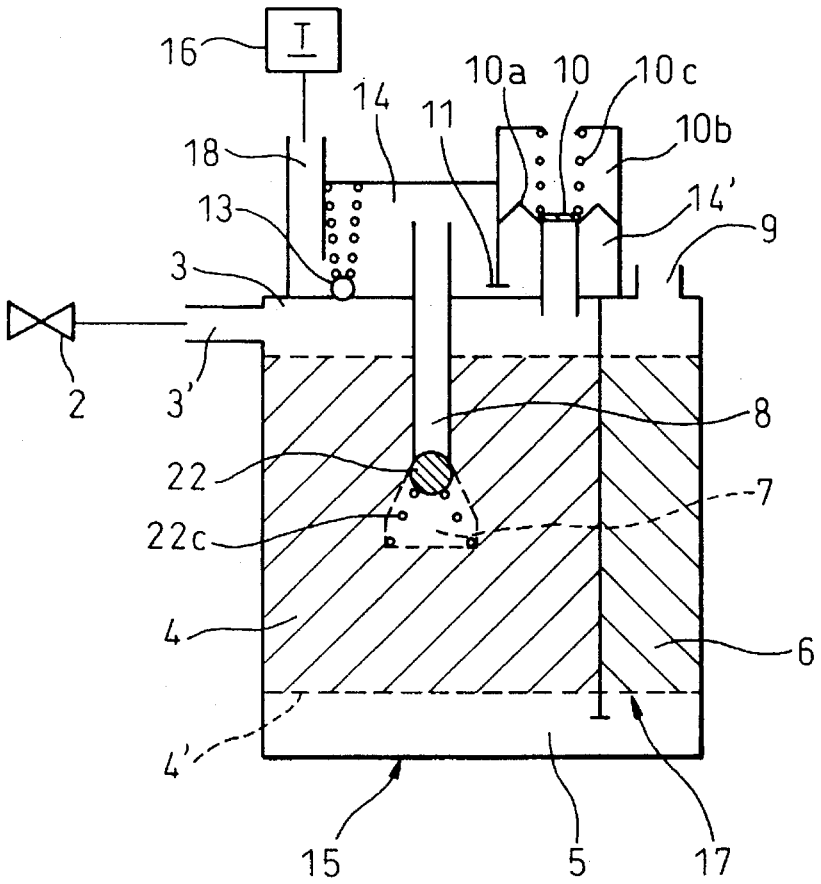
FIG. 3 shows a fuel vapor emission control device for an engine, according to the second embodiment of the present invention.

FIG. 3 shows a second embodiment of the present invention.

Note that, in embodiments which will be explained hereinafter, the fuel vapor diffusion chamber 3 of the canister 15 is connected to the intake passage 1*a* downstream of the throttle valve 1*c* of the engine 1 via the purge passage 3' with the purge control valve 2 arranged therein, as in the first embodiment. Also, an ECU as the ECU 80 shown in FIG. 1 is provided. But, in FIGS. 3, 4A, 5 through 8, 15, and 17, the engine 1 and the ECU are not depicted.

Referring to FIG. 3, the second embodiment employs, instead of the first pressure control valve 12 of the first embodiment, a check valve 22 arranged on the outlet end 7 of the fuel vapor guide 8. The check valve 22 allows only a gas flow from the first fuel vapor chamber 14 toward the adsorbing layer 4'. The valve opening pressure of the check valve 22 is set higher than that of the second pressure control valve 10.

Fuel vapor generated in the fuel tank 16 during the purging operation is introduced through the fuel vapor passage 18 into the first fuel vapor chamber 14 and the second fuel vapor chamber 14'. When the pressure in the second fuel vapor chamber 14' reaches the valve opening pressure of the second pressure control valve 10, the diaphragm 10*a* deforms to open the valve 10. As a result, the fuel vapor in the second fuel vapor chamber 14' flows into a fuel vapor diffusion chamber 3. Since the valve opening pressure of the check valve 22 is set higher than that of the valve 10, the check valve 22 is kept closed if the pressure in the first fuel vapor chamber 14 is not so high or is relatively low. When the pressure in the first fuel vapor chamber 14 is low, i.e., when the amount of fuel vapor introduced from the fuel tank 16 into the canister 15 is small, fuel vapor is purged into the intake passage 1*a* without passing through the adsorbing layer 4'. This means that the effective volume of the adsorbing layer 4' interposed between the fuel tank 16 and the intake passage 1*a* is zero when the amount of fuel vapor introduced from the fuel tank 16 into the canister 15 is small. Namely, when the amount of fuel vapor introduced into the canister 15 is small, the adsorbing operation of the adsorbing layer 4' is not carried out to thereby prolong the service life of the adsorbing layer 4'.

When the amount of fuel vapor produced in the fuel tank 16 becomes larger and thereby the pressure in the first fuel vapor chamber 14 reaches the valve opening pressure of the check valve 22, the check valve 22 opens to introduce fuel vapor in the first fuel vapor chamber 14 into the central portion of the adsorbing layer 4' through the fuel vapor guide 8. Fuel vapor is then adsorbed in the adsorbing layer 4', and is gradually released therefrom due to air passing through the adsorbing layer 4'. The released fuel vapor is purged into the intake passage 1*a*.

In this state, the adsorbing layer 4' interposed between the fuel tank 16 and the intake passage 1*a* is the adsorbing layer portion positioned substantially above the end 7 of the fuel vapor guide 8. Namely, the effective volume of the adsorbing layer 4' is substantially half the total volume of the adsorbing layer 4'. In this way, the effective volume of the adsorbing layer 4' becomes larger when the amount of fuel vapor introduced from the fuel tank 16 to the canister 15 becomes larger. This prevents a drastic change in the amount of the fuel vapor purged into the intake passage 1*a*. Since the fuel vapor is temporarily adsorbed in the adsorbing layer 4' and is purged thereafter into the intake passage 1*a*, the intake passage 1*a* will never receive a large amount of fuel vapor. This prevents the fluctuation in an air-fuel ratio of the engine during the purging operation.

Using the check valve 22, as in the second embodiment, realizes a simple and inexpensive structure for the fuel emission control device.

Since the check valve 22 is arranged inside the adsorbing layer 4', the negative pressure in the adsorbing layer 4', which negative pressure is produced in the intake passage 1*a*, acts on the check valve 22 toward the opening direction thereof. Therefore, if the negative pressure in the adsorbing layer 4' is large, the check valve 22 may be opened even if the pressure in the first fuel vapor chamber 14 is relatively low. As a result, when the negative pressure in the adsorbing layer 4', i.e., the negative pressure in the intake passage 1*a* becomes large, the amount of fuel vapor entering the adsorbing layer 4' through the check valve 22 becomes larger. However, the amount of air introduced into the adsorbing layer 4' through the air inlet 9 becomes larger when the negative pressure in the adsorbing layer 4' becomes larger. This prevents an increase in the concentration of fuel vapor in the purge gas fed to the intake passage la, thereby preventing the wide fluctuation in the air-fuel ratio of the engine.

Further, since the valve opening pressure of the check valve 22 is determined according to the negative pressure in the intake passage 1*a*, fuel vapor in the fuel tank 16 is positively discharged to the outside thereof. This results in always keeping the pressure in the fuel tank 16 low, during the purging operation. The other arrangements and operations of the fuel vapor emission control device according to the second embodiment are the same as those of the first embodiment, and therefore, they are omitted.

Figure 4A:
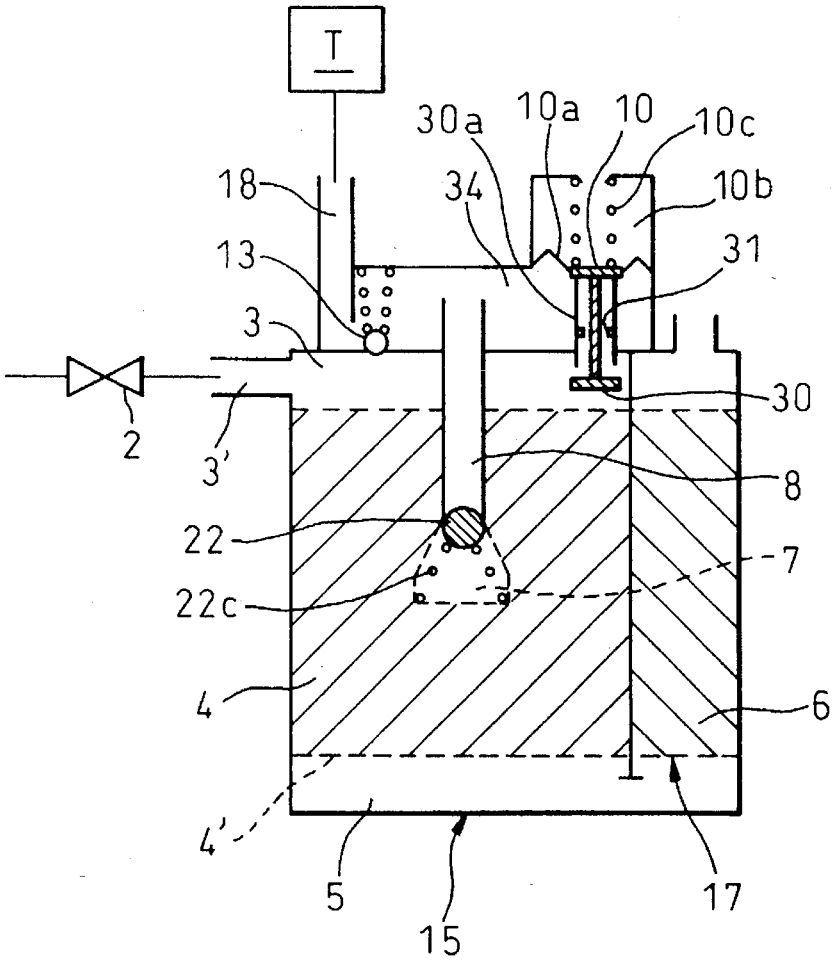
FIGS. 4A and 4B show a fuel vapor emission control device for an engine, according to the third embodiment of the present invention.
Figure 4B:
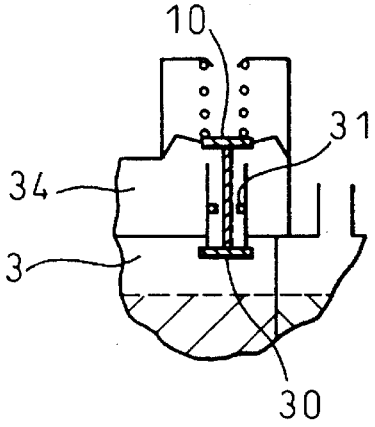

FIGS. 4A and 4B show a third embodiment of the present invention. FIG. 4B is a partial view of the canister 15 for explaining the operation of the valves 10 and 30.

Referring to FIG. 4A, the canister 15 is provided with a single fuel vapor chamber 34 connected to the fuel tank 16. The fuel vapor chamber 34 is also connected, on one hand, to the fuel vapor diffusion chamber 3 via the second pressure control valve 10 and via a change-over valve 30, and, on the other hand, to an adsorbing layer 4' via the fuel vapor guide 8 and via the check valve 22. The change-over valve 30 is integrally fixed to the valve 10 to integrally displace therewith. A connection pipe 30*a* for connecting the fuel vapor chamber 34 and fuel vapor diffusion chamber 3 to each other has a choke 31 therein. The chock 31 produces a resistance to the flow of fuel vapor in the connection pipe 30*a*.

When the pressure in the fuel vapor chamber 34 is relatively low, the second pressure control valve 10 is in contact with an inlet end (namely, an upper end in FIG. 4A) of the connection pipe 30*a*. Namely, the second pressure control valve 10 is closed. In this state, the change-over valve 30 is separate from an outlet end (namely, a lower end in FIG. 4A) of the connection pipe 30*a*. Namely, the valve 30 is opened. Further, at this state, the check valve 22 is also closed.

When the amount of fuel vapor flowing from the fuel tank 16 into the fuel vapor chamber 34 increases to thereby increase the pressure in the fuel vapor chamber 34 up to the valve opening pressure of the second pressure control valve 10, the diaphragm 10*a* deforms to move the valve 10 away from the upper end of the connection pipe 30*a*. Namely, the valve 10 is opened. In this state, if the pressure in the fuel vapor chamber 34 is relatively low or not very high, the change-over valve 30 is displaced away from the lower end of the connection pipe 30*a*. Namely, the valve 30 is opened. Therefore, the fuel vapor in the fuel vapor chamber 34 flows into the fuel vapor diffusion chamber 3 through the valves 10 and 30. At this state, the check valve 22 is kept closed. Accordingly, when the pressure in the fuel vapor chamber 34 is relatively low, i.e., when the amount of fuel vapor introduced from the fuel tank 16 into the canister 15 is relatively small, the fuel vapor is purged into the intake passage 1*a* without passing through the adsorbing layer 4'.

When the pressure in the fuel vapor chamber 34 further increases to further displace the second pressure control valve 10 upward, the change-over valve 30 further displaces upward. When the pressure in the fuel vapor chamber 34 increases up to the valve opening pressure of the check valve 22, the change-over valve 30 gets in contact with the lower end of the connection pipe 30*a*, as shown in FIG. 4B. Namely, the valve 30 is closed. As a result, the fuel vapor chamber 34 is closed against the fuel vapor diffusion chamber 3, while the valve 10 is open. Accordingly, all fuel vapor in the fuel vapor chamber 34 is introduced into the adsorbing layer 4' via the fuel vapor guide 8 and via the check valve 22. The fuel vapor introduced into the layer 4' is temporarily adsorbed therein.

In the third embodiment, the change-over valve 30 is closed when the check valve 22 is opened to thereby introduce fuel vapor into the adsorbing layer 4'. Namely, substantially no fuel vapor in the fuel vapor chamber 34 flows into the fuel vapor diffusion chamber 3 through the connection pipe 30*a*. In other words, when the amount of fuel vapor flowing from the fuel tank 16 to the canister 15 is large and thereby the check valve 22 is opened, all fuel vapor in the fuel vapor chamber 34 is temporarily adsorbed in the adsorbing layer 4'. This prevents a drastic change in the amount of fuel vapor purged into the intake passage 1*a*, as well as the wide fluctuation in the air-fuel ratio. The other arrangements and operations of the fuel vapor emission device according to the third embodiment are the same as those of the second embodiment, and therefore, they are omitted.

Figure 5:
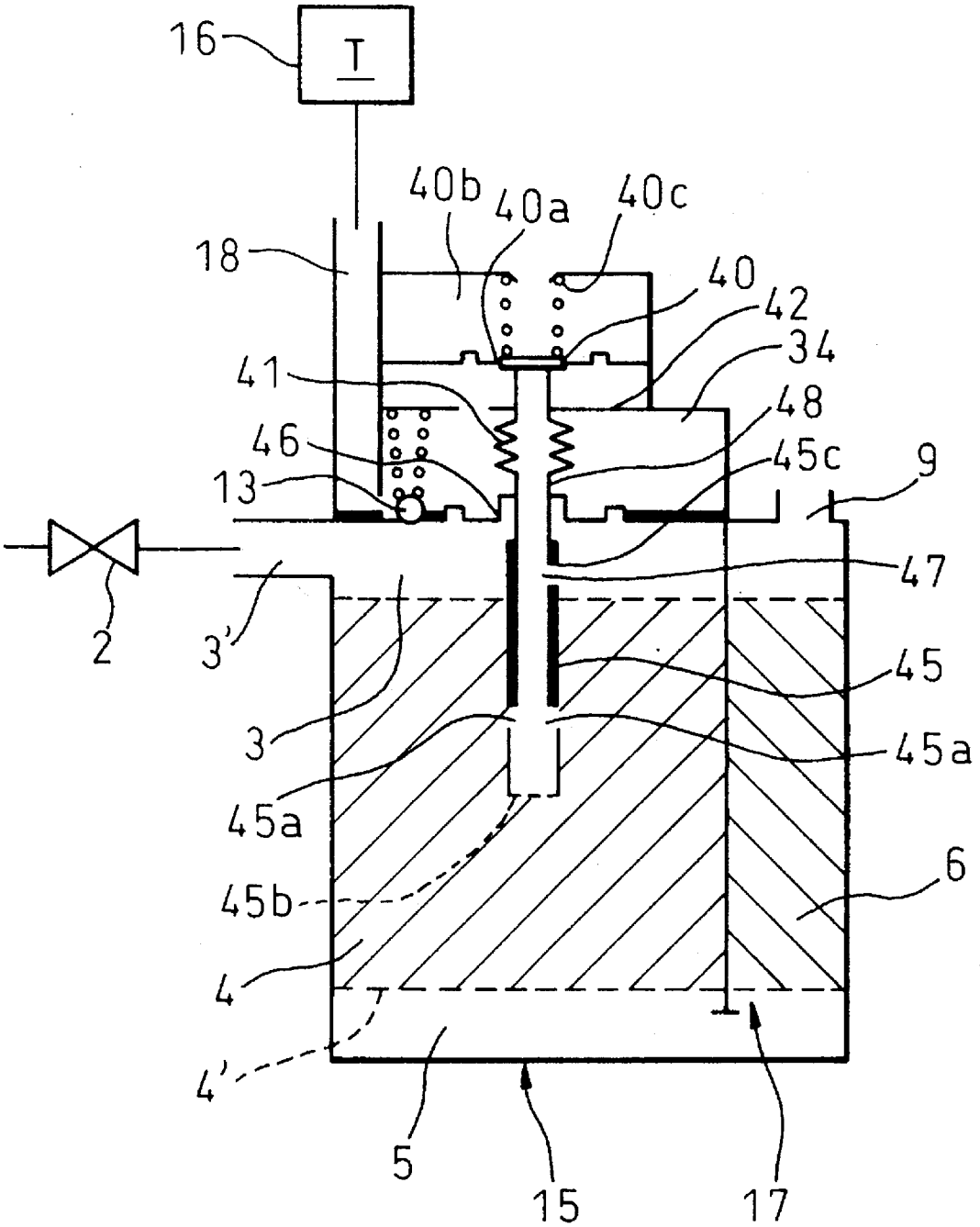
FIG. 5 shows a fuel vapor emission control device for an engine, according to the fourth embodiment of the present invention.

FIG. 5 shows a fourth embodiment of the present invention.

Referring to FIG. 5, the fourth embodiment employs a single pressure control valve 40. The single fuel vapor chamber 34 is selectively connected to one of the fuel vapor diffusion chamber 3 and the adsorbing layer 4', via the pressure control valve 40 and via a fuel vapor guide 48. The fuel vapor guide 48 is fixed to a wall 42 fixed in the fuel vapor chamber 34. The fuel vapor guide 48 is also connected to a diaphragm 46 that defines the fuel vapor chamber 34. The fuel vapor guide 48 has a telescopic bellows portion 41 between the wall 42 and the diaphragm 46. The fuel vapor guide 48 positioned between the fuel vapor diffusion chamber 3 and the outlet end thereof is supported by and slidable in a support pipe 45 fixed in the adsorbing layer 4'. When the diaphragm 46 deforms, the fuel vapor guide 48 displaces relative to the support pipe 45.

The support pipe 45 has an outlet hole 45*c* open to the fuel vapor diffusion chamber 3 and the fuel vapor guide 48 has an outlet hole 47 open to the fuel vapor diffusion chamber 3. The holes 45*c* and 47 can communicate with each other. The support pipe 45 further has an outlet hole 45*b* open to the central portion of the adsorbing layer 4'. In the peripheral wall of the support pipe 45 between the hole 45*b* and the fuel vapor diffusion chamber 3, the pipe 45 further has a pair of outlet holes 45*a*. In the embodiment shown in FIG. 5, the holes 45*a* are at a depth of about one third of the thickness of the adsorbing layer 4' from the top surface thereof. The flow resistances of the holes 45*a* are larger than that of the hole 45*c* and the flow resistance of the hole 45*b* is larger than those of the holes 45*a*.

Referring to FIG. 5 again, a diaphragm 40*a* is connected to the pressure control valve 40. A diaphragm chamber 40*b* is open to the atmosphere. A spring 40*c* biases the pressure control valve 40 toward a closing direction thereof.

When the pressure in the fuel vapor chamber 34 increases, the diaphragm 40*a* deforms to thereby open the pressure control valve 40. In this state, if the pressure in the fuel vapor chamber 34 is not so high, the displacement of the diaphragm 46 is relatively small. As a result, the hole 47 of the fuel vapor guide 48 communicates with the hole 45*c* of the support pipe 45. Accordingly, most of the fuel vapor in the fuel vapor chamber 34 flows into the fuel vapor diffusion chamber 3 through the holes 47 and 45*c*. Namely, the most of fuel vapor in the fuel vapor chamber 34 is purged into the intake passage without passing through the adsorbing layer 4'. The remainder flows into the adsorbing layer 4' through the holes 45*a* and 45*b*.

Figure 6A:
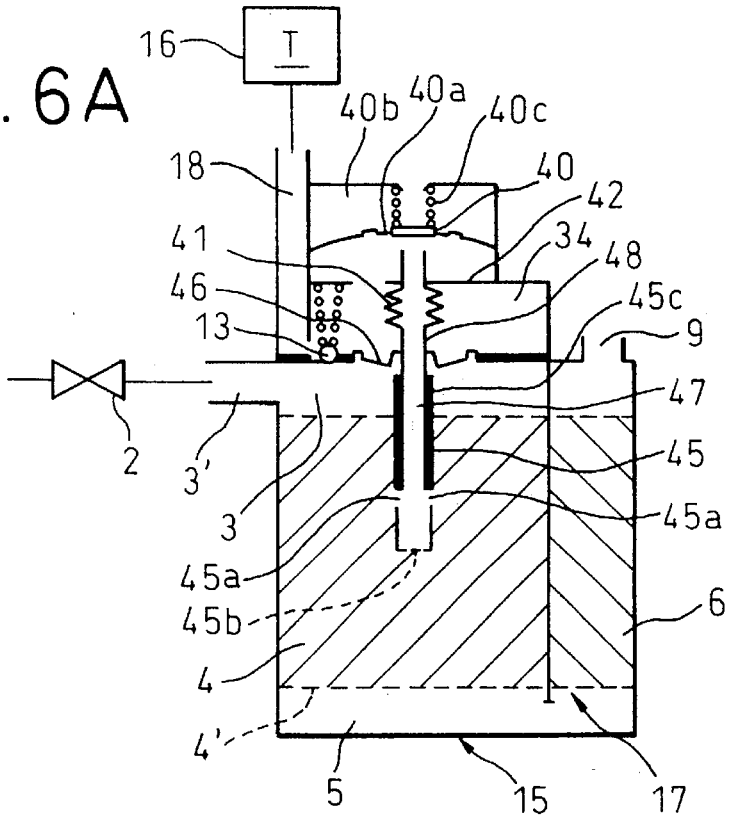
FIGS. 6A, 6B, and 7 show a fuel vapor emission control device for an engine, according to the fifth embodiment of the present invention.

When the pressure in the fuel vapor chamber 34 further increases the diaphragm 46 further deforms to thereby extend the bellows portion 41 of the fuel vapor guide 48 downwardly (the direction is shown in the figures). As a result, the fuel vapor guide 48 moves downwardly, relative to the wall 42, so that the wall of the support pipe 45 closes the hole 47 of the fuel vapor guide 48, and that the hole 45*c* of the support pipe 45 is closed by the wall of the fuel vapor guide 48, while the holes 45*a* is kept open, as shown in FIG. 6A. Accordingly, most of the fuel vapor in the fuel vapor chamber 34 flows into the adsorbing layer 4' through the holes 45*a* of the support pipe 45.

Figure 6B:
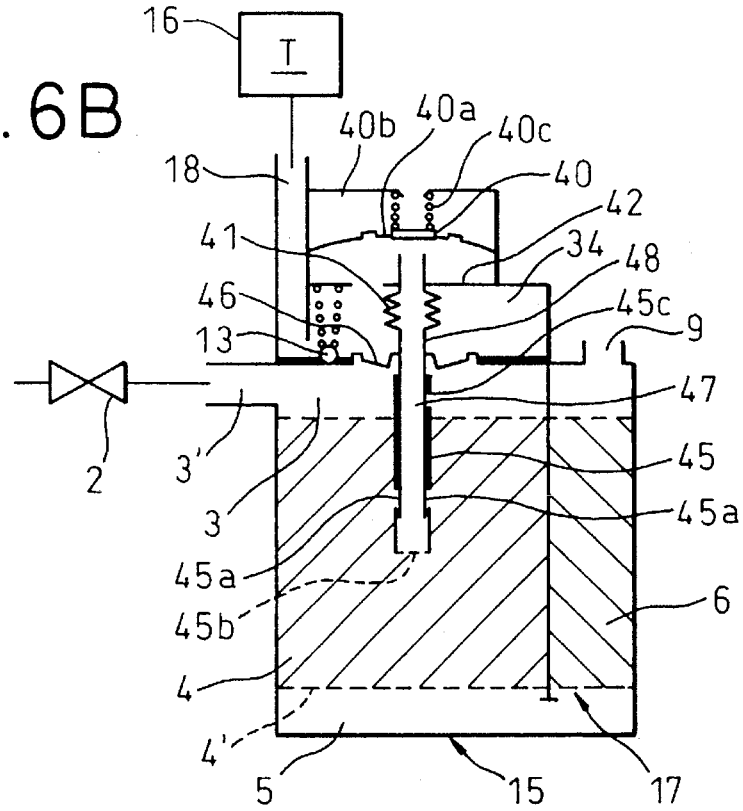

When the pressure in the fuel vapor chamber 34 further increases, the diaphragm 46 displaces further to thereby move the fuel vapor guide 48 further downward. As a result, the holes 45*a* of the support pipe 45 are closed by the wall of the fuel vapor guide 48, while the hole 47 of the fuel vapor guide 48 and the hole 45*c* of the support pipe 45 are kept closed, as shown in FIG. 6B. Accordingly, all of fuel vapor in the fuel vapor chamber 34 flows into the adsorbing layer 4' through the hole 45*b* of the support pipe 45.

Namely, when the pressure in the fuel vapor chamber 34 is relatively low, i.e., when the amount of fuel vapor introduced from the fuel tank 16 into the canister 15 is relatively small, fuel vapor in the fuel vapor chamber 34 is mainly purged into the fuel vapor diffusion chamber 3 through the holes 47 and 45*c*, without being introduced into the adsorbing layer 4'. In this state, the effective volume of the adsorbing layer 4' interposed between the fuel tank 16 and the intake passage 1*a* is zero.

When the pressure in the fuel vapor chamber 34 increases, fuel vapor in the fuel vapor chamber 34 mainly flows into the adsorbing layer 4' through the holes 45*a*. In this state, the adsorbing layer 4' between the holes 45*a* and the fuel vapor diffusion chamber 3 is interposed between the fuel tank 16 and the intake passage 1*a*. Namely, the effective volume of the adsorbing layer 4' is about one third of the total volume thereof.

When the pressure in the fuel vapor chamber 34 further increases, fuel vapor in the fuel vapor chamber 34 flows into the adsorbing layer 4' through the hole 45*b*. In this state, the adsorbing layer 4' between the hole 45*b* and the fuel vapor diffusion chamber 3 is interposed between the fuel tank 16 and the intake passage 1*a*. Namely, the effective volume of the adsorbing layer 4' is about half the total volume thereof. In this way, the effective volume of the adsorbing layer 4' interposed between the fuel tank 16 and the intake passage 1*a* becomes larger when the amount of fuel vapor introduced from the fuel tank 16 into the canister 15 becomes larger. This prevents a drastic change in the amount of fuel vapor purged into the intake passage 1*a* to thereby prevent the wide fluctuation in the air-fuel ratio, as well as a rapid deterioration of the adsorbing layer 4'. The other arrangements and operations of the fuel vapor emission control device according to fourth embodiment are the same as those of the first embodiment and, therefore, they are omitted.

Figure 7:
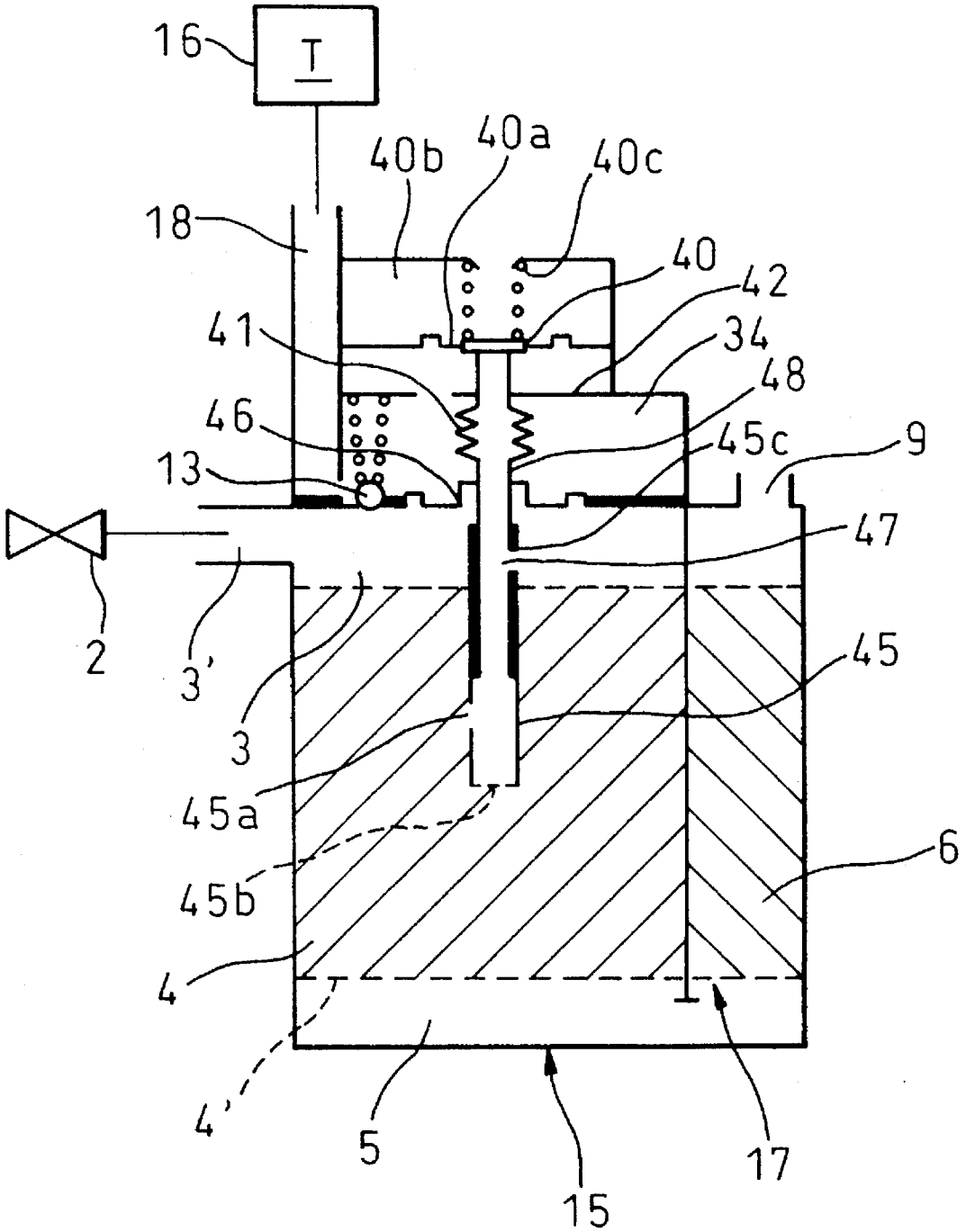

FIG. 7 shows a fifth embodiment of the present invention. In the fifth embodiment, a single hole 45*a* on the peripheral wall of the support pipe 45 is oriented only toward the purge passage 3'. The other arrangements of the fifth embodiment are the same as those of the fourth embodiment.

When the pressure in the fuel vapor chamber 34 increases to move the fuel vapor guide 48 downwardly to thereby close the hole 47 of the fuel vapor guide 48 and the hole 45*c* of the support pipe 45, fuel vapor in the fuel vapor chamber 34 is introduced into an adsorbing layer 4' through the hole 45*a*. In this state, since the hole 45*a* is oriented to the purge passage 3', the fuel vapor discharged from the hole 45*a* is adsorbed in the adsorbing layer 4' positioned substantially between the hole 45*a* and the purge passage 3'. In other words, substantially no fuel vapor from the hole 45*a* is guided to the adsorbing layer 4' opposite to the purge passage 3' with respect to the fuel vapor guide 48. Namely, compared with the fourth embodiment, the device in the fifth embodiment more positively changes the area of the adsorbing layer 4' for temporarily adsorbing fuel vapor. Therefore, a deterioration of the adsorbing layer 4' is more effectively suppressed.

Figure 8:
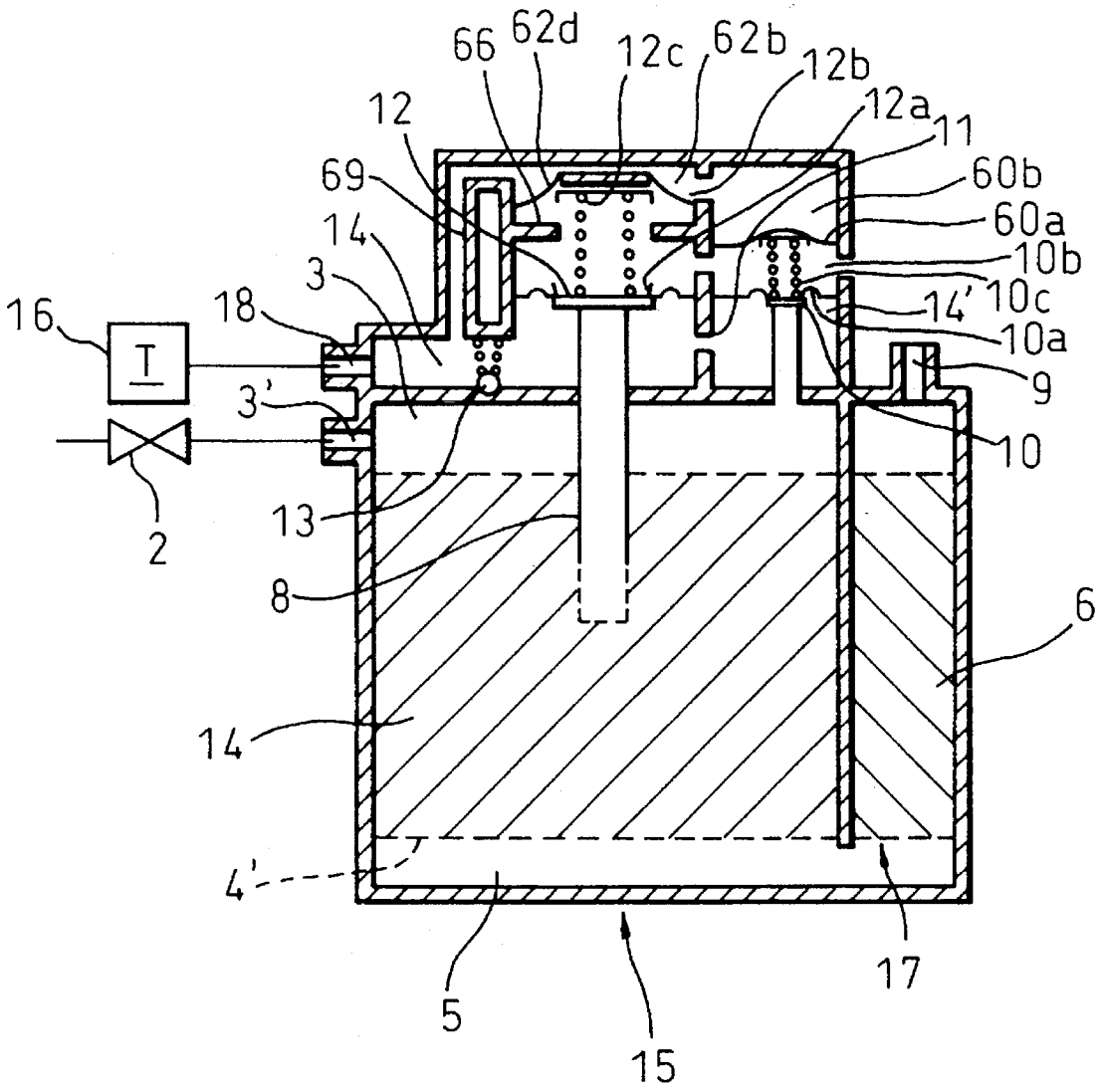
FIG. 8 shows a fuel vapor emission control device for an engine, according to the sixth embodiment of the present invention.

FIG. 8 shows a sixth embodiment of the present invention. Similar to the first embodiment, the first and second fuel vapor chambers 14 and 14' are provided in the canister 15. The first pressure control valve 12 is arranged in the first fuel vapor chamber 14, and the second pressure control valve 10 is arranged in the second fuel vapor chamber 14'. The valve opening pressure of the first pressure control valve 12 is controlled by the spring 12*c*. An end of the spring 12*c* opposite to the valve 12 is attached to the diaphragm 62*d*. The valve opening pressure of the second pressure control valve 10 is controlled by the spring 10*c*. An end of the spring 10*c* opposite to the valve 10 is attached to the diaphragm 60*d*. As is apparent from FIG. 8, the diaphragm 62*d* defines a first back pressure chamber 62*b*, and the diaphragm 60*d* defines a second back pressure chamber 60*b*. The first and second back pressure chambers 62*b* and 60*b* are connected to each other. The first back pressure chamber 62*b* is connected to the first fuel vapor chamber 14 through a communication passage 69.

A stopper 66 for restricting the displacement of the diaphragm 62*d* is provided in the diaphragm chamber 12*b*. The diaphragm chambers 12*b* and 10*b* are open to the atmosphere.

When the pressures in the first and second fuel vapor chambers 14 and 14' increase up to the valve opening pressure of the second pressure control valve 10, the valve 10 is opened to thereby introduce fuel vapor in the second fuel vapor chamber 14' into the fuel vapor diffusion chamber 3. When the pressures in the first and second fuel vapor chambers 14 and 14' further increase up to the valve opening pressure of the first pressure control valve 12, the valve 12 is opened to thereby introduce fuel vapor in the first fuel vapor chamber 14 into the central portion of the adsorbing layer 4' via the fuel vapor guide 8.

As the pressures in the first and second fuel vapor chambers 14 and 14' increase, the pressures in the first and second back pressure chambers 62*b* and 60*b* also increase. For example, when the pressure in the first back pressure chamber 62*b* increases, the diaphragm 62*d* is pushed downwardly to thereby increase the valve opening pressure of the first pressure control valve 12. Therefore, when the pressure in the first and second fuel vapor chambers 14 and 14' becomes higher, i.e., when the amount of fuel vapor introduced from a fuel tank 16 into the canister 15 becomes larger, the valve opening pressures of the first and second pressure control valves 12 and 10 becomes higher. As a result, the pressure in the fuel tank 16 may easily reach the saturation pressure of the fuel. As the pressure in the fuel tank 16 reaches the saturation pressure of the fuel, the evaporation of the fuel is suppressed, and therefore, the amount of the fuel vapor introduced from the fuel tank 16 to the canister 15 is reduced. This means that the amount of fuel vapor introduced into the adsorbing layer 4' decreases, to prevent an excessive purge of fuel vapor into an intake passage 1*a*. Namely, the concentration of fuel vapor in the purge gas is kept low and stabilized to prevent the wide fluctuation in the air-fuel ratio. Further, reducing the amount of fuel vapor introduced into the adsorbing layer 4' may prevent the deterioration of the adsorbing layer 4'.

When the pressure in the first back pressure chamber 62*b* further increases, the stopper 66 restricts the further displacement of the diaphragm 12*a* to restrict the increment of the valve opening pressure of the first pressure control valve 12. Accordingly, the pressure in the fuel tank 16 will never be abnormally increased.

The sixth embodiment may further employ a change-over valve to isolate the second fuel vapor chamber 14' from the fuel vapor diffusion chamber 3 when the first pressure control valve 12 is opened, as in the third embodiment. This prevents fuel vapor in the second fuel vapor chamber 14' from being fed directly into the fuel vapor diffusion chamber 3 when the fuel tank 16 provides the canister 15 with a large amount of fuel vapor. Namely, all fuel vapor is purged into the intake passage 1*a* through the adsorbing layer 4' to thereby keep the concentration of fuel vapor in the purge gas low.

The device according to the sixth embodiment is applicable to an engine having a controller for feedback controlling the opening degree of the purge control valve 2 to make the concentration of fuel vapor in air fed into the engine equal to a target value thereof, or a controller for feedback controlling the amount of fuel to be injected to make the air-fuel ratio of the engine equal to a target value thereof. In each case, the device keeps the concentration of fuel vapor in the purge gas low to thereby reduce the wide fluctuation in the air-fuel ratio due to a control delay in the feedback control. The other arrangements and operations of the device of the sixth embodiment are the same as those of the first embodiment, and therefore, they are omitted.

Figure 9:
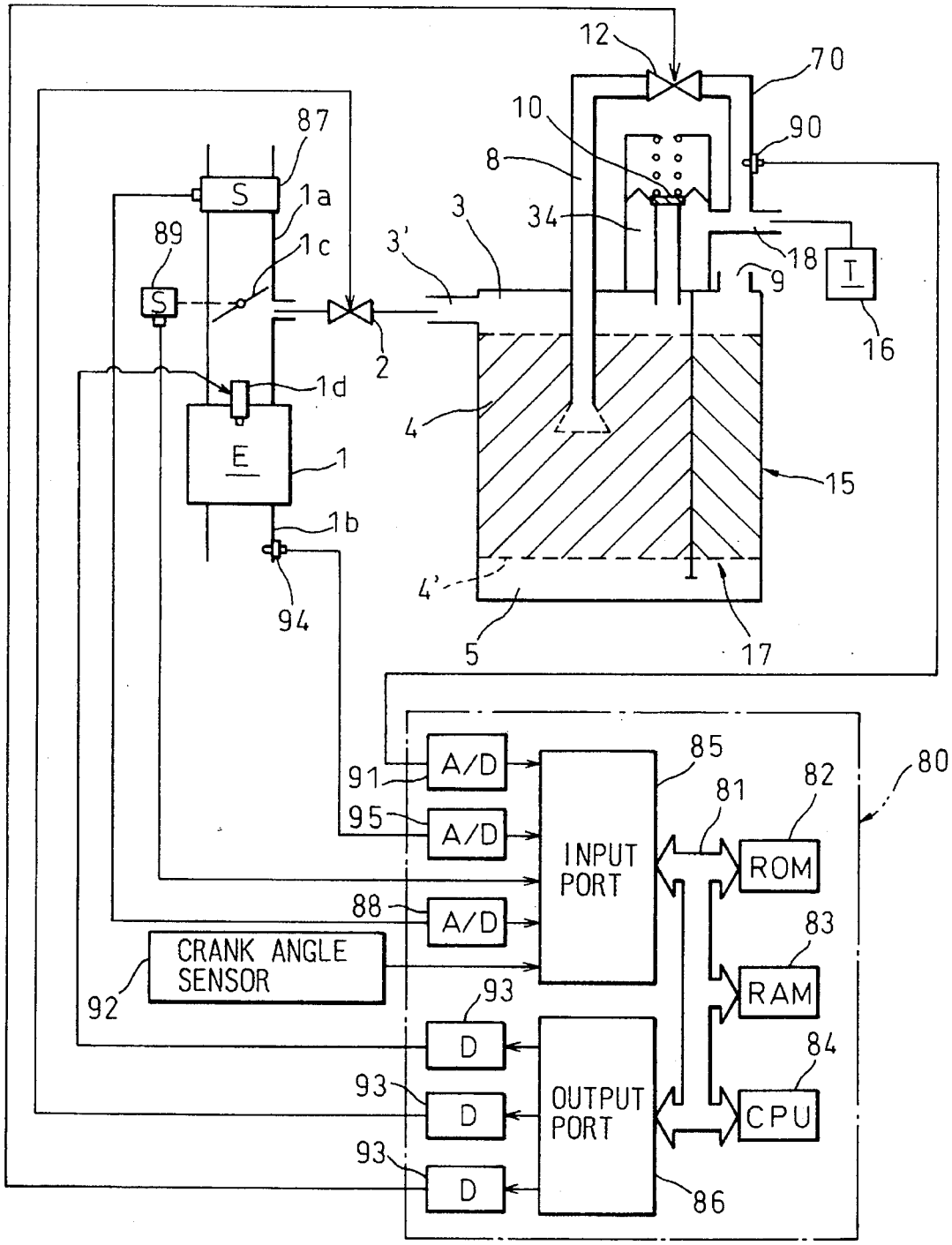
FIG. 9 shows a fuel vapor emission control device for an engine, according to the seventh embodiment of the present invention.

FIG. 9 shows a seventh embodiment of the present invention. Similar to the third embodiment, the seventh embodiment employs the single fuel vapor chamber 34 connected to the fuel tank 16 via the fuel vapor passage 18. The fuel vapor chamber 34 is connected to the fuel vapor diffusion chamber 3 via the second pressure control valve 10. The fuel vapor passage 18 has a branch 70 connected to the fuel vapor guide 8 extending to the central portion of the adsorbing layer 4'. The branch 70 has the first pressure control valve 12 therein. According to the seventh embodiment, the first pressure control valve 12 is a solenoid valve that is opened and closed in response to an output signal provided by an electronic control unit 80. Further, in the seventh embodiment, the valve 12 is selectively controlled to one of the open and closed states. Alternatively, the valve 12 may be a vacuum driven type valve.

The electronic control unit 80 is constructed as a digital computer including a ROM (read only memory) 82, a RAM (random access memory) 83, a CPU (microprocessor) 84, an input port 85, and an output port 86. The ROM 82, RAM 83, CPU 84, the input port 85, and the output port 86 are connected to each other by a bidirectional bus 81. An airflow meter 87 for generating an output voltage in proportion to the amount of air fed into the engine is arranged in an intake passage 1*a* upstream of a throttle valve 1*c*. The output voltage of the airflow meter 87 is input to the input port 85 through an AD converter 88. The throttle valve 1*c* is connected to a throttle switch 89 that is turned ON when the throttle valve 1*c* is in the idling opening position. The output signal of the throttle switch 89 is input to the input port 85. A pressure sensor 90 is arranged in the branch 70 between the fuel vapor passage 18 and the first pressure control valve 12 for providing an output voltage in proportion to the pressure in the branch 70, namely the pressure in the fuel tank 16. The output voltage of the pressure sensor 90 is input to the input port 85 through an AD converter 91. The air-fuel ratio sensor 94 arranged in the exhaust passage 1*b* produces an output voltage representing the air-fuel ratio of the engine 1. The output voltage of the air-fuel ratio sensor 94 is input to the input port 85 via an AD converter 95. The input port 85 is connected also to a crank angle sensor 92 that generates an output pulse each time the crankshaft rotates, for example, by 30-degrees. According to the output pulse, the CPU 84 calculates an engine speed.

The output port 86 is connected to the purge control valve 2, the first pressure control valve 12, and a fuel injector 1*d* for feeding the pressurized fuel into the engine 1, respectively, via a corresponding drive circuit 93.

In the engine shown in FIG. 9, the fuel injection time TAU is calculated using the following equation:

$$TAU=TP\cdot FAF\cdot K$$

where

TP: basic fuel injection time

KK: enrichment coefficient

FAF: feedback correction coefficient

The basic fuel injection time TP is a fuel injection time required to make the air-fuel ratio of air-fuel mixture fed into the engine equal to a target air-fuel ratio, and is previously obtained by experiment. This basic fuel injection time TP is stored in advance in the ROM 22 as a function of an engine speed N and an engine load Q/N (an amount of air Q/the engine speed N).

The enrichment coefficient KK is a coefficient for increasing the amount of fuel to be fed into the engine at the time of warm-up of the engine or at the time of acceleration of the engine. This enrichment coefficient KK is made 1.0 when the increase operation of the amount of fuel is not required.

The feedback correction coefficient FAF is a coefficient for correcting the amount of fuel to be fed to make the air-fuel ratio equal to the target air-fuel ratio, based on signals output from the air-fuel ratio sensor 94. When the air-fuel ratio detected by the air-fuel ratio is on the rich side with respect to the target air-fuel ratio, the feedback correction coefficient FAF is decremented to thereby shorten the fuel injection time TAU, and when the air-fuel ratio detected by the air-fuel ratio is on the lean side with respect to the target air-fuel ratio, the feedback correction coefficient FAF is incremented to thereby extend the fuel injection time TAU. In this way, the air-fuel ratio is made equal to the target air-fuel ratio. The feedback correction coefficient FAF fluctuates around 1.0.

When the pressure in the fuel vapor chamber 34 increases up to the valve opening pressure of the second pressure control valve 10, the valve 10 is opened. In this state, the first pressure control valve 12 is kept closed. As a result, fuel vapor in the fuel vapor chamber 34 flows into the fuel vapor diffusion chamber 3. In this case, the effective volume of the adsorbing layer 4' interposed between the fuel tank 16 and the intake passage 1*a* is zero to thereby suppress the deterioration of the adsorbing layer 4'.

When the pressure in the fuel vapor chamber 34 further increases so that a pressure PT detected by the pressure sensor 90 reaches a predetermined pressure P1 that is higher than the valve opening pressure of the second pressure control valve 10, the first pressure control valve 12 is opened. As a result, the fuel vapor introduced from the fuel tank 16 into the canister 15 is introduced into the central portion of the adsorbing layer 4' through the branch 70 and through the fuel vapor guide 8. In this case, the effective volume of the adsorbing layer 4' interposed between the fuel tank 16 and the intake passage 1*a* is substantially half the total volume of the adsorbing layer 4'. This prevents a drastic change in the amount of fuel vapor purged into the intake passage 1*a*. In this way, the effective volume of the adsorbing layer 4' interposed between the fuel tank 16 and the intake passage 1*a* becomes larger when the amount of fuel vapor supplied from the fuel tank 16 to the canister 15 becomes larger.

If the amount of fuel vapor to be purged into the intake passage 1*a* fluctuates, the air-fuel ratio may widely fluctuate accordingly. On the other hand, when the amount of air fed into the engine becomes larger, the influence of the fluctuation in the amount of fuel vapor purged into the intake passage 1*a* on the air-fuel ratio becomes smaller. Accordingly, the seventh embodiment closes the first pressure control valve 12 when the amount of air fed into the engine Q is equal to or larger than a predetermined amount Q1, even if $PT \geqq P1$ wherein the first pressure control valve 12 is to be opened. As a result, no fuel vapor is introduced into the adsorbing layer 4' through the fuel vapor guide 8. Namely, the fuel vapor is purged into the intake passage 1*a* through the second pressure control valve 10 and fuel vapor diffusion chamber 3, without passing through the adsorbing layer 4'. In this case, the effective volume of the adsorbing layer 4' interposed between the fuel tank 16 and the intake passage 1*a* is zero, to thereby reduce the deterioration of the adsorbing layer 4'.

On the other hand, the engine shown in FIG. 9 temporarily stops the fuel injection by the fuel injector 1*d* according to an engine operating conditions. Namely, when the engine is decelerated and when an engine speed N is larger than a first predetermined speed N1, the fuel injection is stopped to thereby minimize fuel consumption. When the engine speed N during the stoppage of the fuel injection drops below a second predetermined speed N2, which is lower than the first predetermined speed N1, the fuel injection is resumed to stop the engine misfiring.

When the fuel injection is temporarily stopped, an air-fuel mixture formed by fuel vapor is too lean. Therefore, if the purging operation is carried out under this state, the fuel may be discharged into the exhaust passage 1*b* without being burned. To solve this problem, the seventh embodiment stops the purging operation when the fuel injection is stopped. As a result, fuel vapor is prevented from being discharged into the exhaust passage 1*b*, without being burned.

If the first pressure control valve 12 is closed when the fuel injection and the purging operation are stopped, a relatively large amount of fuel vapor introduced into the canister 15 may be supplied into the fuel vapor diffusion chamber 3 through the second pressure control valve 10. Since the purge control valve 2 is closed during the stoppage of the purging operation, a large amount of fuel vapor will fill the fuel vapor diffusion chamber 3. However, if the purge control valve 2 is opened to restart the purging operation under this state, the large amount of fuel vapor in the fuel vapor diffusion chamber 3 may be purged into the intake passage 1*a* to thereby cause a wide fluctuation in the air-fuel ratio.

To solve this problem, the seventh embodiment opens the first pressure control valve 12 when the fuel injection and purging operation are to be stopped. As a result, fuel vapor is introduced into the adsorbing layer 4'. Namely, the fuel vapor diffusion chamber 3 will not be filled with a large amount of fuel vapor during the stoppage of the purging operation due to the stoppage of the fuel injection. In other words, a large amount of fuel vapor will never be purged into the intake passage 1*a* when the purging operation is resumed. This results in preventing the wide fluctuation in the air-fuel ratio when the purging operation is restarted.

On the other hand, the seventh embodiment controls the first pressure control valve 12 according to a deviation of the feedback correction coefficient FAF from the reference value 1.0. The mean feedback correction coefficient FAFAV fluctuates around 1.0. When the deviation "1–FAFAV" of the mean feedback correction coefficient FAFAV is within a predetermined range of –X to X, a deviation of the actual air-fuel ratio from the target air-fuel ratio is small. Namely, the air-fuel ratio does not fluctuate widely. Here, the value X is a small constant. The seventh embodiment determines that the air-fuel ratio may not widely fluctuate if $-X \leqq 1-FAFAV \leqq X$, and therefore, closes the first pressure control valve 12 to introduce no fuel vapor into the adsorbing layer 4', even if $PT \geqq P1$. As a result, fuel vapor in the fuel vapor chamber 34 flows into the fuel vapor diffusion chamber 3 through the second pressure control valve 10, and is purged into the intake passage 1*a*. This results in further preventing the deterioration of the adsorbing layer 4'. If the deviation is out of the range, namely, if $-X > 1-FAFAV$ or if $1-FAFAV > X$, the fuel vapor is introduced into the central portion of the adsorbing layer 4' through the fuel vapor guide 8, to thereby prevent a large amount of fuel vapor from being purged into the intake passage 1*a*.

Figure 10:
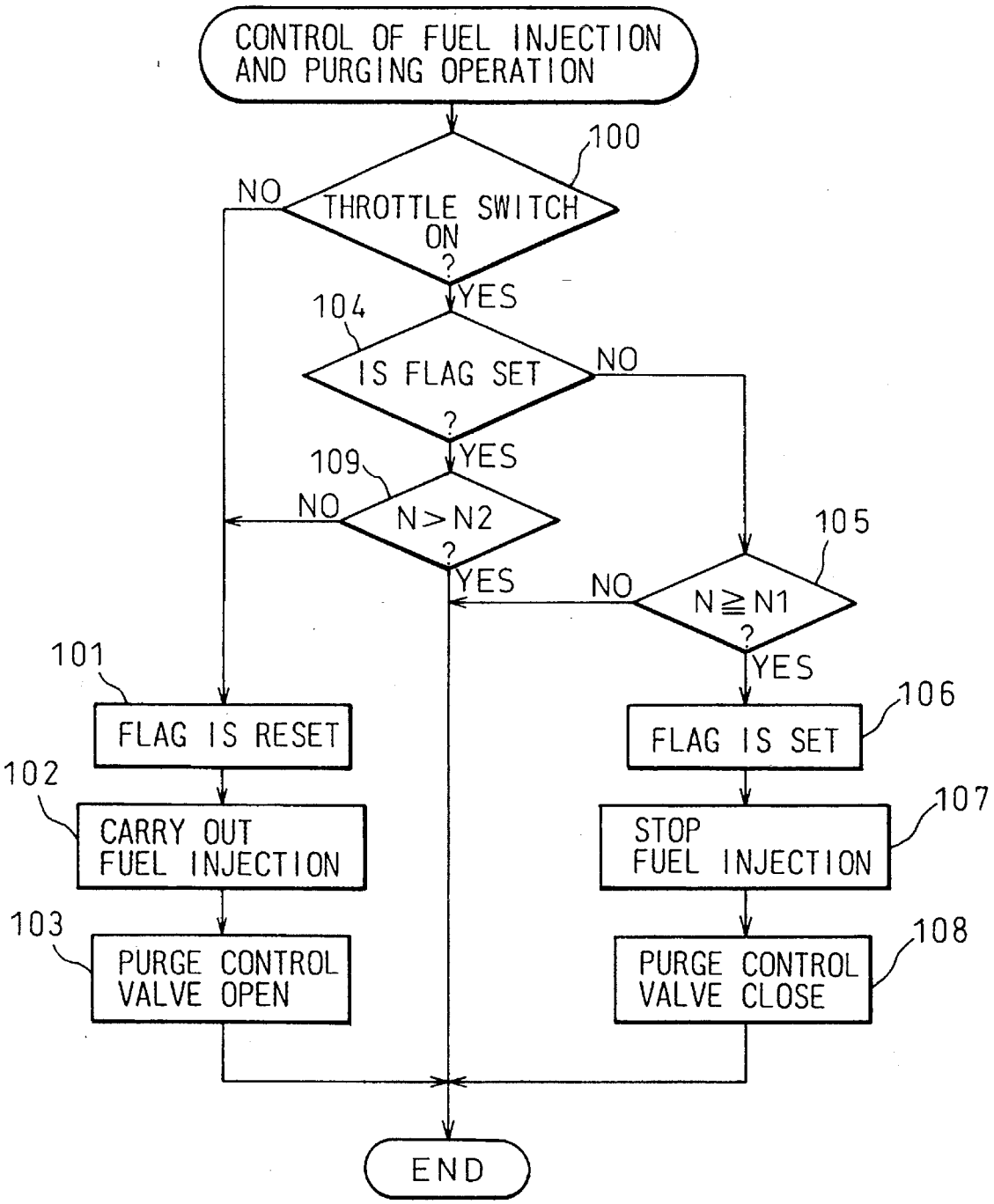
FIG. 10 shows a flowchart for executing control of the fuel injection and the purging operation, according to the seventh embodiment of the present invention.
Figure 11:
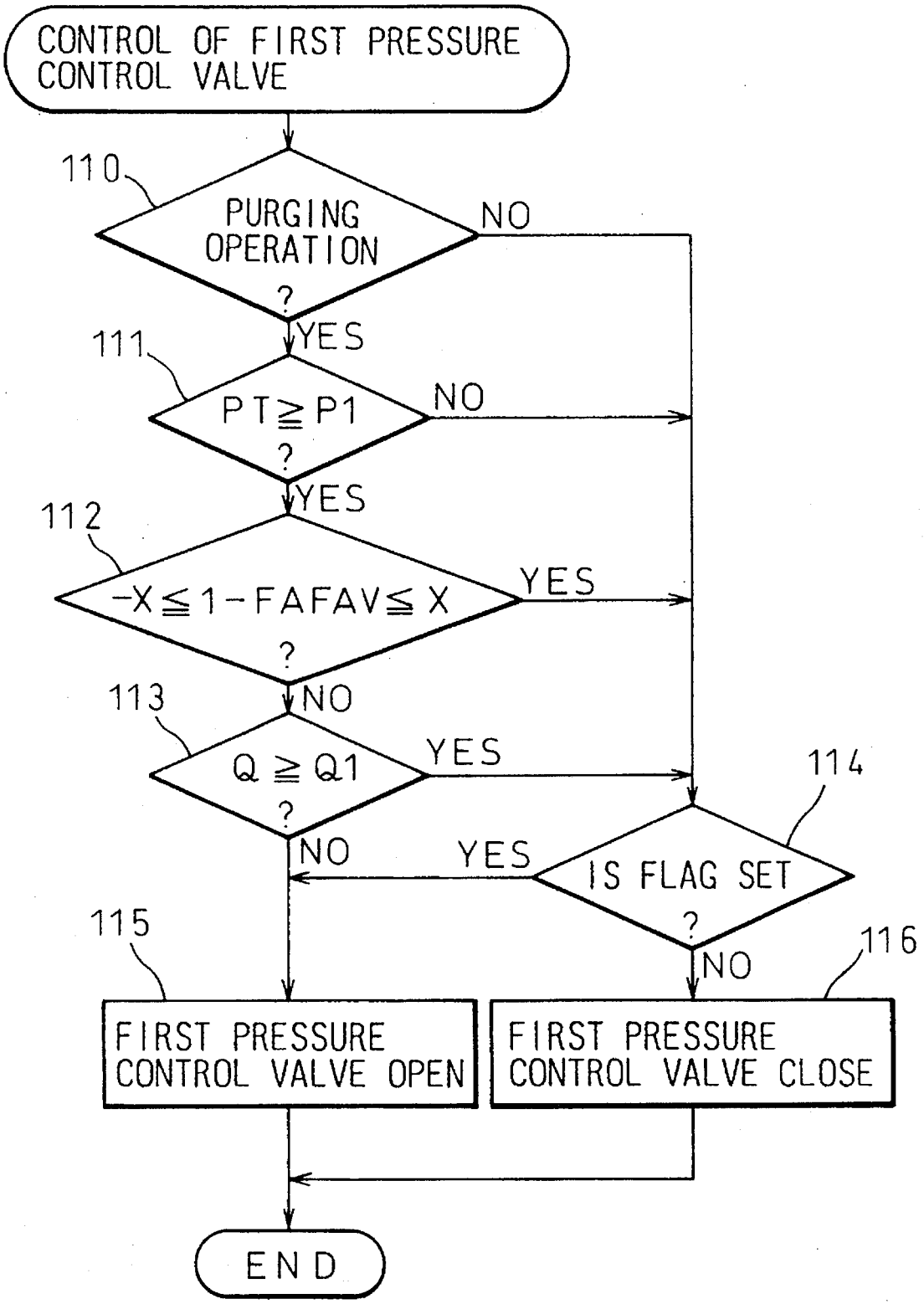
FIG. 11 shows a flowchart for executing control of the first pressure control valve, according to the seventh embodiment of the present invention.

FIGS. 10 and 11 illustrate routines for executing the seventh embodiment mentioned above. FIG. 10 shows a routine for executing the control of the fuel injection and the purging operation. This routine is executed in, for example, a main routine.

Referring to FIG. 10, first, in step 100, it is determined whether the throttle switch 89 is turned ON. If the throttle switch 89 is turned OFF, the routine goes to step 101, where a flag, which is set when the fuel injection and the purging operation are to be temporarily stopped, is reset. In following step 102, the fuel injection is carried out. In following step 103, the purge control valve 2 is opened to carry out the purging operation.

If the throttle switch 89 is turned ON in step 100, the routine goes to step 104, where it is determined whether the flag is set. If the flag is reset, the routine goes to step 105, where it is determined whether the engine speed N is equal to or larger than the first predetermined value N1. If $N < N1$, the processing cycle is ended. Namely, the flag is kept reset, and the fuel injection and the purging operation is continuously carried out.

If $N \geqq N1$ in step 105, the routine goes to step 106, where the flag is set. In the following step 107, the fuel injection is temporarily stopped. Accordingly, the fuel consumption is reduced. In following step 108, the purge control valve 2 is closed to stop the purging operation. Accordingly, fuel is prevented from discharging into the exhaust passage 1*b* without being burned. Then, the processing cycle is ended.

If the throttle switch 89 is ON and the flag is set in step 104, the routine goes to step 109, where it is determined whether the engine speed N is equal to or higher than the second predetermined value N2. If $N \geqq N2$, the processing cycle is ended. Namely, the flag is kept set, and the fuel injection and purging operation are continuously stopped. If $N < N2$ in step 109, the routine goes to steps 101, where the flag is reset. In the following steps 102 and 103, the fuel injection and the purging operation are carried out. Namely, the fuel injection and purging operation are resumed. Then, the processing cycle is ended.

FIG. 11 shows a routine for executing the control of the first pressure control valve 12. This routine is executed in, for example, a main routine.

Referring to FIG. 11, first, in step 110, it is determined whether the purging operation is in process. If the purging operation is in process, the routine goes to step 111, and if the purging operation is not in process, the routine goes to step 114. In step 111, it is determined whether the pressure PT detected by the pressure sensor 90 is equal to or higher than the predetermined pressure P1. If $PT \geqq P1$, the routine goes to step 112, if $PT < P1$, the routine goes to step 114.

In step 112, it is determined whether the deviation of the mean feedback correction coefficient "1–FAFAV" is within the predetermined range of –X to X. If $-X \leqq 1-FAFAV \leqq X$, the routine goes to step 114. If $-X > 1-FAFAV$, or $1-FAFAV > X$, the routine goes to step 113, where it is determined whether the amount of air fed into the engine Q detected by the airflow meter 87 is equal to or greater than the predetermined amount Q1. If $Q \geqq Q1$, the routine goes to step 114, and if $Q < Q1$, the routine goes to step 115.

If the purging operation is stopped in step 110, the routine goes to step 114, where it is determined whether the flag set or reset in the routine shown in FIG. 10 is set. The purging operation is to be stopped when a purge starting condition in which the purging operation can be started has not been established, such as during a warming-up operation of the engine, or when the fuel injection is to be stopped. When the routine goes to step 114 because the purge starting condition has not been established, the flag is reset. Therefore, in this case, the routine goes to step 116. On the other hand, when the routine goes to step 114 from any one of the steps 111, 112, and 113, the purging operation is in process, and therefore, the flag is reset. Therefore, in this case, the routine also goes to step 116. In step 116, the first pressure control valve 12 is closed to increase the effective volume of the adsorbing layer 4' interposed between the fuel tank 16 and the intake passage 1*a*. Then, the processing cycle is ended.

If the flag is set in step 114, the routine goes to step 115, where the first pressure control valve 12 is opened to introduce fuel vapor to decrease the effective volume of the adsorbing layer 4' interposed between the fuel tank 16 and the intake passage 1*a*. Then, the processing cycle is ended.

Namely, in the seventh embodiment, fuel vapor in the fuel tank 16 is introduced into the adsorbing layer 4' when a first condition is established, and is introduced into the fuel vapor diffusion chamber 3 without passing through the layer 4 when a second condition is established. The first condition is established when (i) the purging operation is in process with all of
  (a) the pressure in the fuel tank 16 being high ($PT \geqq P1$),
  (b) the deviation of the mean feedback correction coefficient being large ($-X > 1-FAFAV$, or $1-FAFAV > X$), and
  (c) the amount of air fed into the engine being small ($Q < Q1$), or (ii) the purging operation is stopped due to the stoppage of the fuel injection.

The second condition is established when (i) the purging operation is not started, or (ii) the purging operation is in process with at least one of
  (a) the pressure in the fuel tank 16 being low ($PT > P1$),
  (b) the deviation of the mean feedback correction coefficient being small ($-X \leqq 1-FAFAV \leqq X$), and
  (c) the air fed into the engine amount being large ($Q \geqq Q1$).

In this connection, when the amount of air fed into the engine becomes small, the influence of the fluctuation in the amount of fuel vapor purged into the intake passage 1*a* on the air-fuel ratio becomes large. Therefore, when $Q < Q1$, even if $PT < P1$ wherein the first pressure control valve 12 is to be closed, the first pressure control valve 12 may be opened to introduce fuel vapor to the adsorbing layer 4'. This prevents a drastic change in the amount of fuel vapor purged into the intake passage 1*a* to thereby prevent the wide fluctuation in the air-fuel ratio when the amount of air is small.

Next, an eighth embodiment of the present invention will be explained.

The device of the eighth embodiment is the same as that of the seventh embodiment shown in FIG. 9. Similar to the seventh embodiment, the eighth embodiment temporarily stops fuel injection and the purging operation depending on engine operating conditions. However, the eighth embodiment controls the opening ratio of the first pressure control valve 12 according to a duty ratio. The duty ratio is a ratio of the opening time of the valve 12 to a duty cycle time, in each duty cycle.

When the first condition (i) or (ii) mentioned above is established, the eighth embodiment increments the duty ratio DUTY for the first pressure control valve 12 by a constant Y to thereby increase the amount of fuel vapor introduced into the adsorbing layer 4'. This results in preventing a large amount of fuel vapor from being purged into the intake passage 1*a*.

When the second condition (i) or (ii) is established, the eighth embodiment decrements the duty ratio DUTY by the constant Y, to thereby decrease the amount of fuel vapor introduced into the adsorbing layer 4'. Namely, the amount of fuel vapor introduced into the fuel vapor chamber 34 is increased and, when the pressure in the fuel vapor chamber 34 reaches the valve opening pressure of the second pressure control valve 10, fuel vapor in the fuel vapor chamber 34 flows into the fuel vapor diffusion chamber 3 through the valve 10. This reduces a deterioration of the adsorbing layer 4'. Note that the judgement regarding which condition is established is carried out at predetermined time intervals. Further, the duty ratio DUTY is determined from 0% to 100%.

Figure 12:
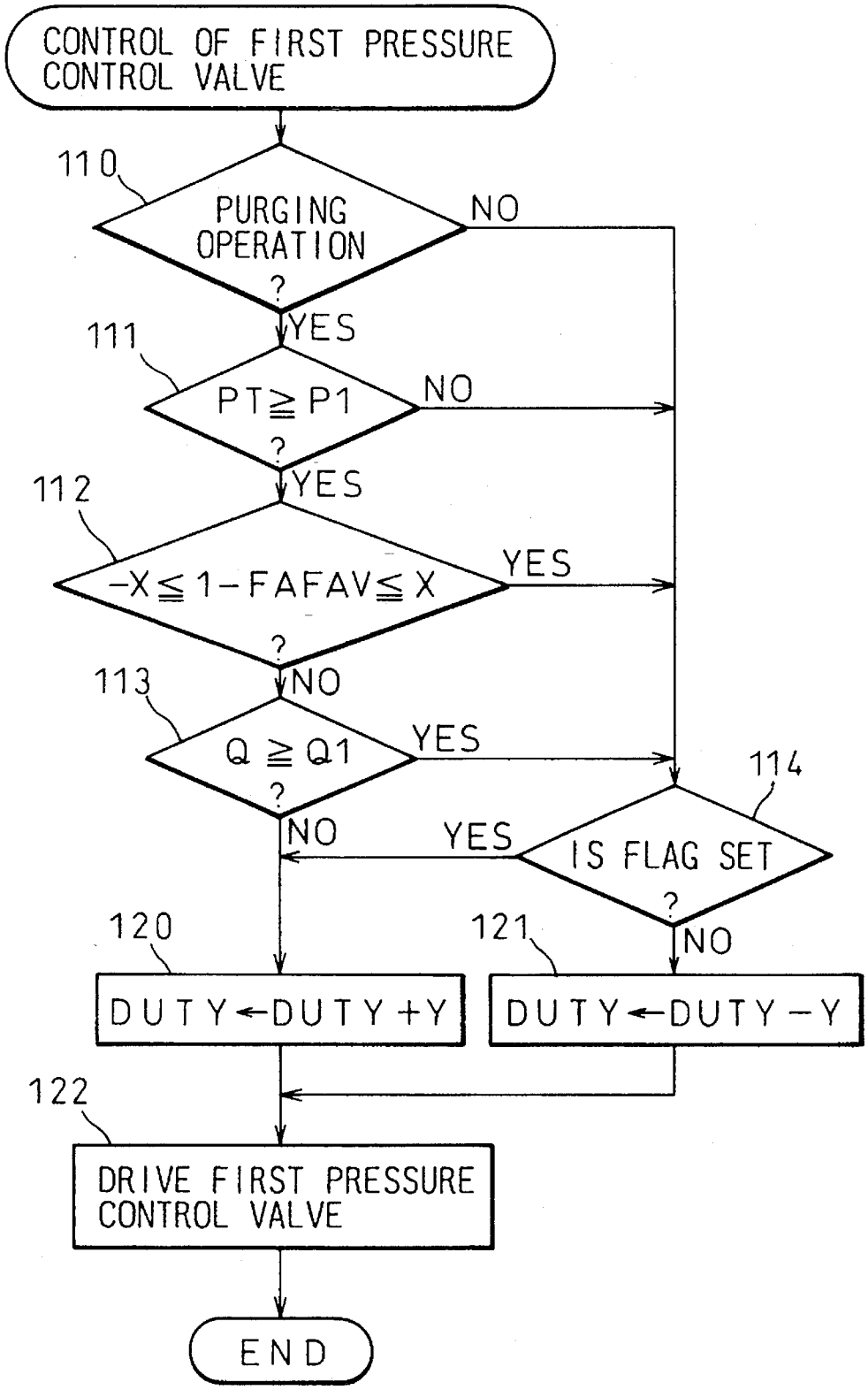
FIG. 12 shows a flowchart for executing control of the first pressure control valve, according to the eighth embodiment of the present invention.

A routine for executing the eighth embodiment will be explained with reference to FIG. 12. This routine includes the same steps as those of the routine shown in FIG. 11. These steps are represented with the same reference numerals, and the explanations thereof are omitted.

If Q<Q1 in step 113, or if the flag controlled by the routine of FIG. 10 is set in step 114, namely, if the first condition (i) or (ii) is established, the routine goes to step 120, where the duty ratio DUTY for the first pressure control valve 12 is incremented by the constant Y. Then, the routine goes to step 122. If the flag is not set in the step 114, namely, if the second condition (i) or (ii) is established, the routine goes to step 121, where the duty ratio DUTY is decremented by the constant Y. Then, the routine goes to step 122.

In step 122, the first pressure control valve 12 is driven so that the opening thereof is made equal to the duty ratio DUTY calculated in one of the steps 120 and 121. Then, the processing cycle is ended. The other arrangements and operations of the device of the eighth embodiment are the same as those of the seventh embodiment, and therefore, they are omitted.

A ninth embodiment of the present invention will be explained. The arrangement of the device of the ninth embodiment is the same as that of the seventh embodiment. Similar to the seventh embodiment, the ninth embodiment temporarily stops fuel injection and purging operation according to engine operating conditions. Similar to the eighth embodiment, the ninth embodiment controls the opening of the first pressure control valve 12 based on the duty ratio.

In the ninth embodiment, the duty ratio DUTY is made equal to 0% when the purging operation is not started, or when the purging operation is in process with at least one of (a) the pressure in the fuel tank 16 being low and (b) the deviation of the mean feedback correction coefficient being small. Namely, all of fuel vapor from the canister 15 is introduced into the fuel vapor diffusion chamber 3. As a result, the deterioration of the adsorbing layer 4' is reduced.

The duty ratio DUTY is made equal to 100% when the purging operation is temporarily stopped due to the stoppage of the fuel injection. Namely, all of fuel vapor from the canister 15 is introduced into the adsorbing layer 4'. As a result, the fuel vapor diffusion chamber 3 is prevented from being filled with a large amount of fuel vapor.

Figure 13:
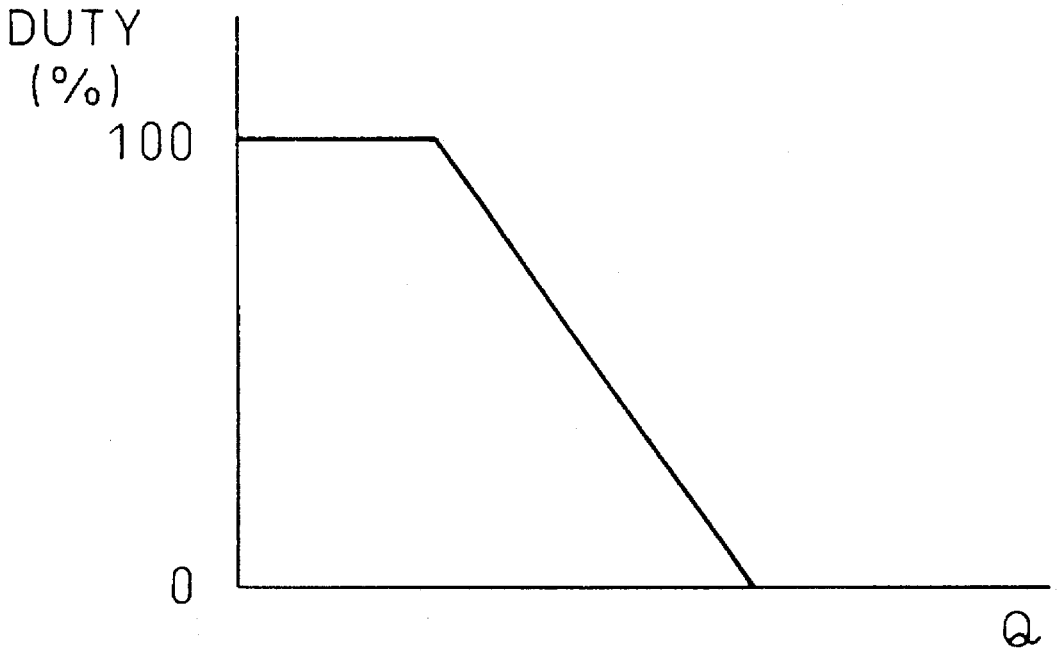
FIG. 13 shows the relationship between a duty ratio for a first pressure control valve and the amount of air fed into the engine.

The duty ratio DUTY is determined based on the amount of air fed into the engine Q, using the relationships shown in FIG. 13, when the purging operation is in process with both of (a) the pressure in the fuel tank 16 being high and (b) the deviation of the mean feedback correction coefficient being large.

FIG. 13 illustrates relationships between the duty ratio DUTY for the first pressure control valve 12 and the amount of air fed into the engine Q. As can be seen in FIG. 13, the duty ratio DUTY becomes small when the amount of air Q becomes larger. Namely, the amount of fuel vapor supplied to the adsorbing layer 4' through the fuel vapor guide 8 becomes smaller when the amount of air Q becomes large, to thereby reduce the deterioration of the adsorbing layer 4'. The relationships between the duty ratio DUTY and the amount of air Q is stored in advance, in the form of a map as shown in FIG. 13, in the ROM 82.

Figure 14:
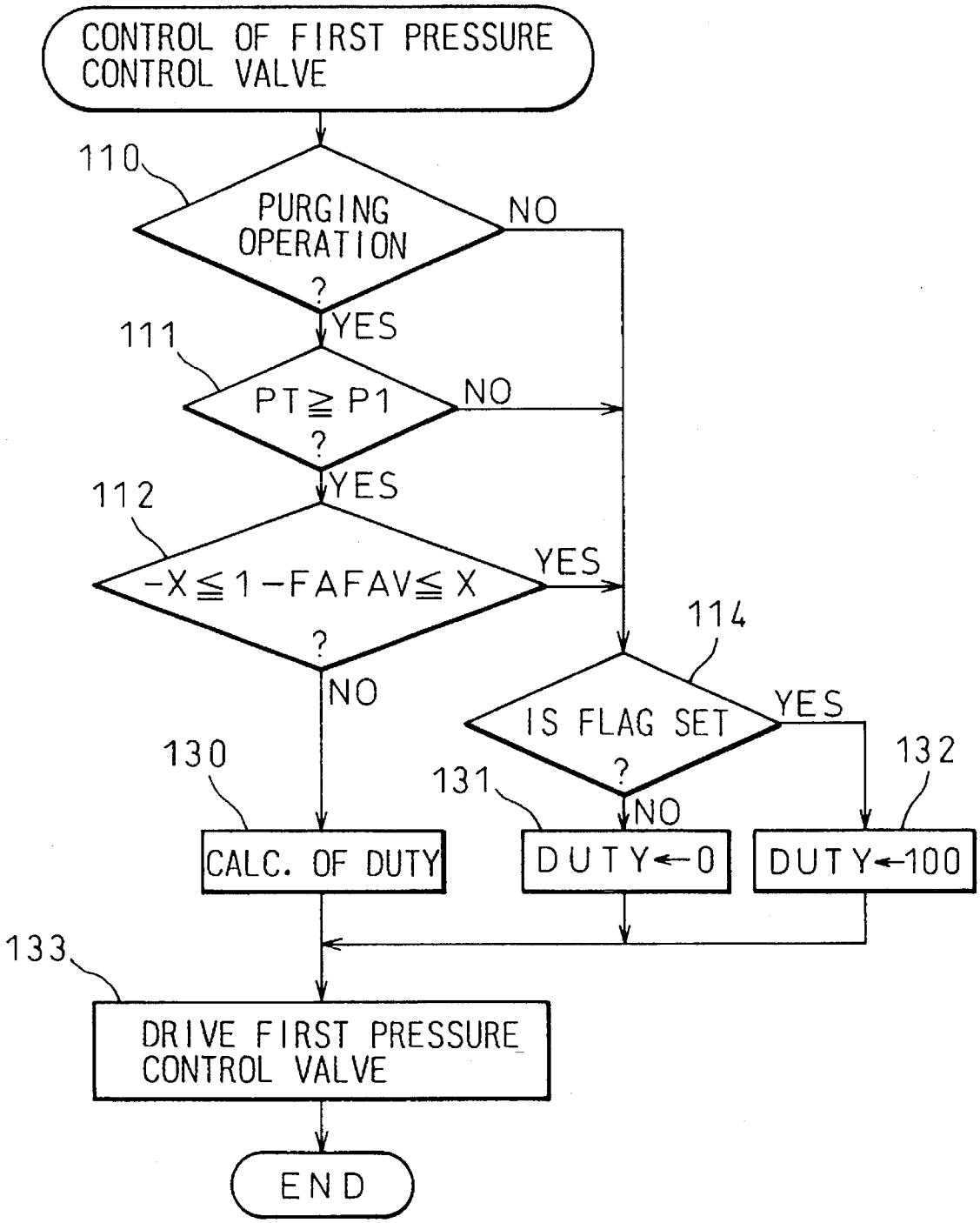
FIG. 14 shows a flowchart for executing control of the first pressure control valve, according to the ninth embodiment of the present invention.

A routine for executing the ninth embodiment will be explained with reference to FIG. 14. This routine includes the same steps as those of the embodiment of FIG. 11. These steps are represented with same reference numerals, and the explanations thereof are omitted.

If −X>1−FAFAV or if 1−FAFAV>X in step 112, the routine goes to step 130, where the duty ratio DUTY for controlling the opening of the first pressure control valve 12 is calculated using the map shown in FIG. 13. Then, the routine goes to step 133.

If the flag, which is set or reset in the routine shown in FIG. 10, is reset in step 114, the routine goes to step 131, where the duty ratio DUTY is made equal to 0%. Then, the routine goes to step 133. If the flag is set in step 114, the routine goes to step 132, where the duty ratio DUTY is made equal to 100%. Then, the routine goes to step 133.

In step 133, the first pressure control valve 12 is driven so that the opening thereof is made equal to the duty ratio DUTY obtained in any one of the steps 130, 131, and 132. Then, the processing cycle is ended.

Figure 15:
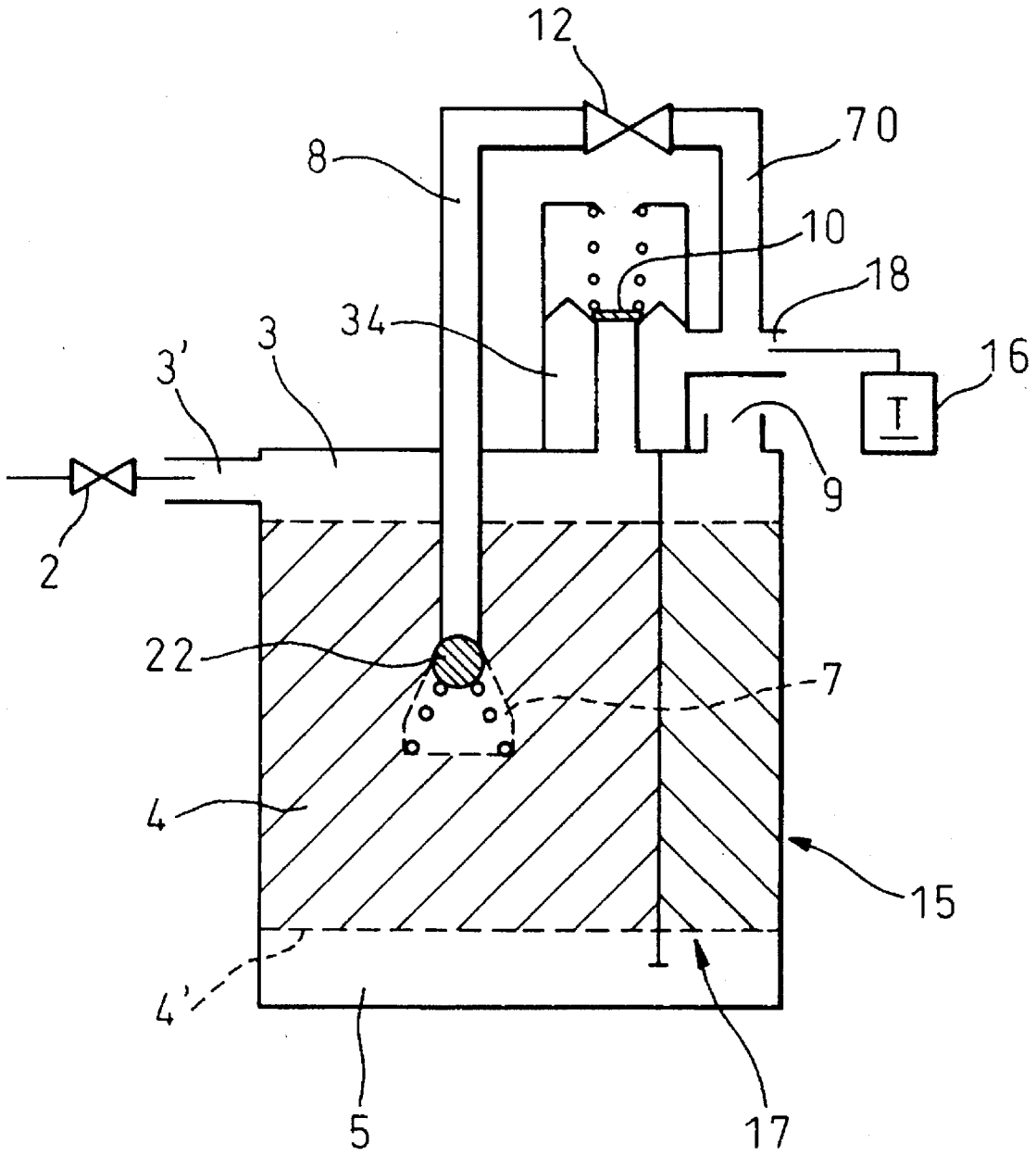
FIG. 15 shows a fuel vapor emission control device for an engine, according to the tenth embodiment of the present invention.

FIG. 15 shows a tenth embodiment of the present invention. An arrangement of the device according to the tenth embodiment is substantially the same as that of the seventh embodiment shown in FIG. 9. However, a pressure sensor in the branch 70 is not needed. Further, the outlet end 7 of the fuel vapor guide 8 has the check valve 22, similar to the second embodiment. The valve opening pressure of the check valve 22 is higher than that of the second pressure control valve 10.

As the period during which the purging operation is continuously carried out becomes longer, the amount of fuel vapor introduced from the fuel tank 16 into the canister 15 becomes smaller and, when the purging operation period reaches, for example, 30 minutes, the amount of fuel vapor introduced from the fuel tank 16 into the canister 15 may be very small. Further, the amount of fuel vapor adsorbed in an adsorbing layer 4' becomes smaller as the purging operation period becomes longer. Therefore, when the purging operation period becomes longer, there will be substantially no risk of purging a large amount of fuel vapor into the intake passage 1*a*. Accordingly, when the purging operation period TD exceeds a predetermined period T1, the tenth embodiment closes the first pressure control valve 12 to stop introducing fuel vapor into the adsorbing layer 4'. This results in reducing a deterioration of the adsorbing layer 4'.

If TD<T1, it is judged that the amount of fuel vapor to be purged into the intake passage 1*a* is large, namely, the amount of fuel vapor introduced from the fuel tank 16 into the canister 15 and fuel vapor released from the adsorbing layer 4' is large. In this condition, the embodiment opens the first pressure control valve 12 to introduce fuel vapor into the adsorbing layer 4', to thereby prevent a large amount of fuel vapor from being purged into the intake passage 1*a*.

Figure 16:
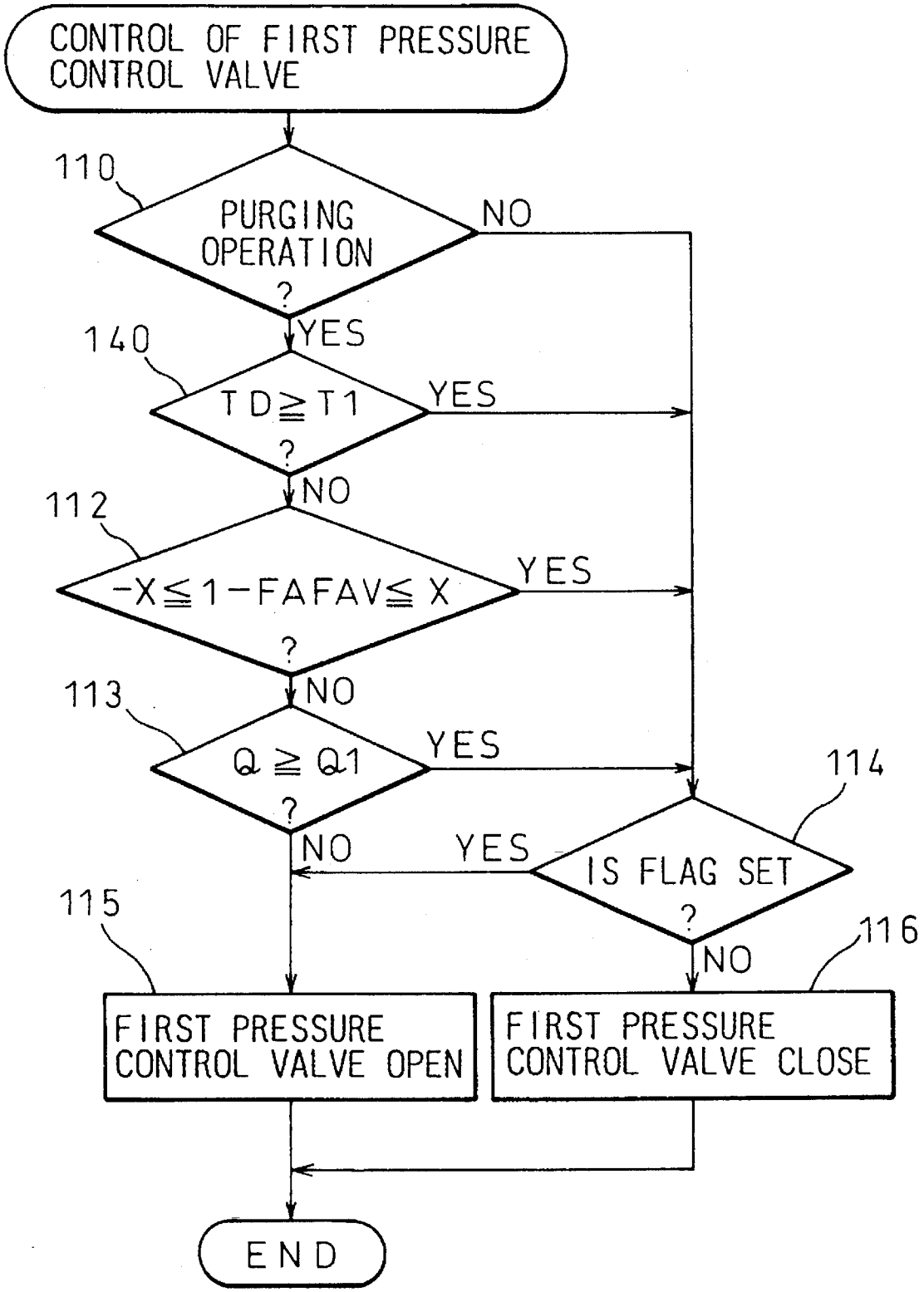
FIG. 16 is a flowchart for executing control of the first pressure control valve, according to the tenth embodiment of the present invention.

A routine for executing the tenth embodiment will be explained with reference to FIG. 16. This routine includes the same steps as those of the routine of FIG. 11. These steps are represented with same reference numerals, and the explanations thereof are omitted.

If the purging operation is in process in step 110, the routine goes to step 140, where it is determined whether the purging operation period TD is equal to or longer than the predetermined period T1. If TD≧T1, the routine goes to step 114. If TD<T1, the routine goes to step 112. The purging operation period TD is detected by a timer incorporated in, for example, the electronic control unit 80.

Namely, in the tenth embodiment, the first condition is established when (iii) the purging operation is in process with all of
  (a) the purging operation period being short,
  (b) the deviation of the mean feedback correction coefficient being large, and
  (c) the amount of air fed into the engine being small, or (iv) the purging operation is stopped due to the stoppage of the fuel injection.

The second condition is established when (i) the purging operation is not started, or (iii) the purging operation is in process as well as the fuel injection with at least one of
  (a) the purging operation period being long,
  (b) the deviation of the mean feedback correction coefficient being small, and
  (c) the air fed into the engine amount being large.

In the tenth embodiment, the check valve 22 is arranged at the end 7 of the fuel vapor guide 8. Due to the check valve 22, the pressure in the fuel vapor guide 8, i.e., the pressure in the fuel tank 16 can increase up to the valve opening pressure of the check valve 22, even if the first pressure control valve 12 is open. This results in increasing the pressure in the fuel tank 16 up to the saturation fuel vapor pressure in the fuel, to thereby suppress the generation of fuel vapor.

Figure 17:
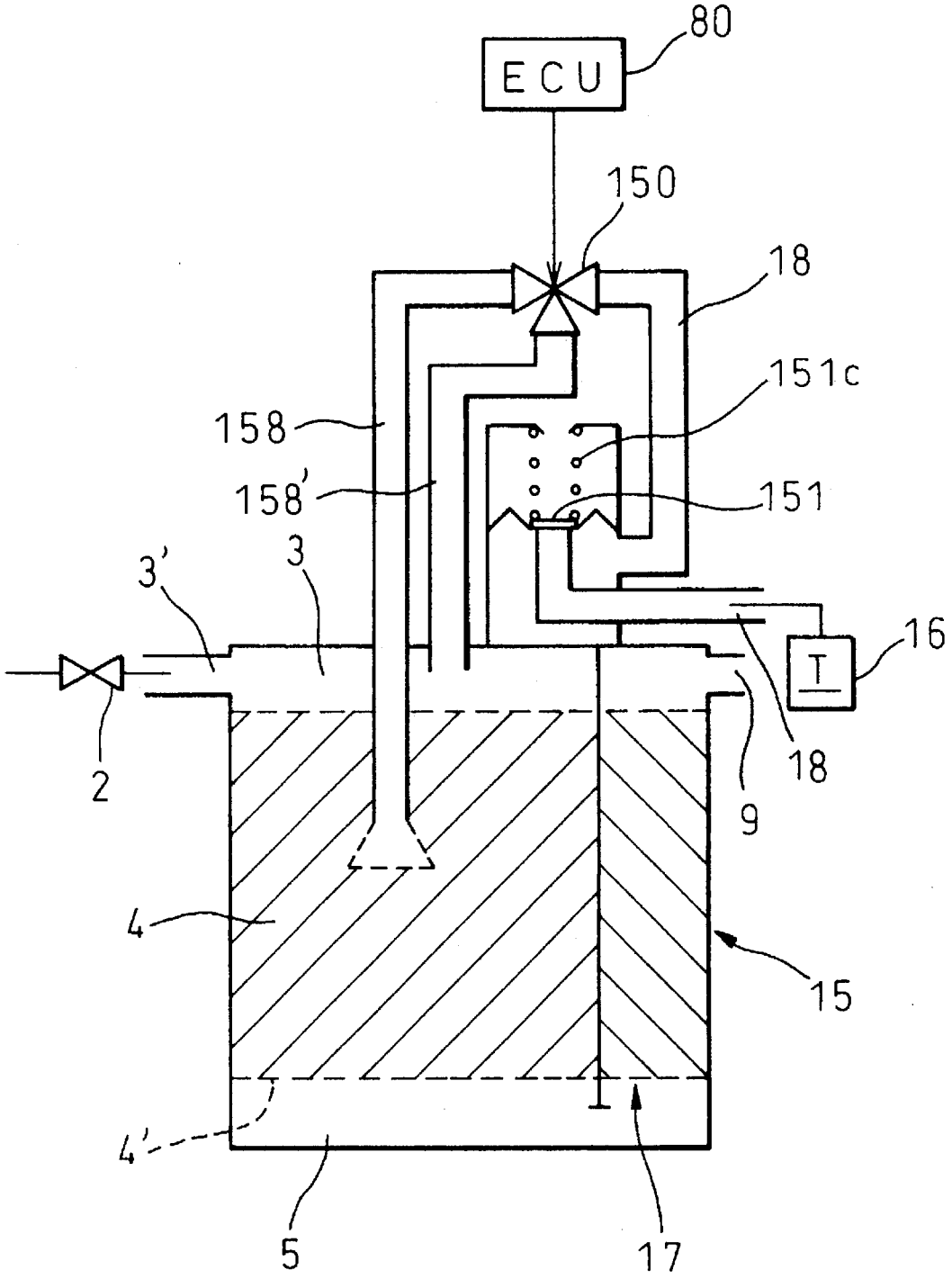
FIG. 17 shows a fuel vapor emission control device for an engine, according to the eleventh embodiment of the present invention.

FIG. 17 shows an eleventh embodiment of the present invention. In the eleventh embodiment, the fuel vapor passage 18 is selectively connected to one of a first fuel vapor guide 158 and a second fuel vapor guide 158' via a three way valve 150. The valve 150 is connected to the drive circuit 93 in the ECU 80, and is controlled in accordance with output signals from the ECU 80. The first fuel vapor guide 158 extends substantially to the central portion of the adsorbing layer 4'. The second fuel vapor guide 158' opens to the fuel vapor diffusion chamber 3. The fuel vapor passage 18 has a pressure control valve 151 therein.

The eleventh embodiment controls the three way valve 150 to connect the fuel vapor passage 18 to the first fuel vapor guide 158 when the first condition (iii) or (iv) of the tenth embodiment is established, to thereby introduce fuel vapor into the adsorbing layer 4' through the first fuel vapor guide 158. This results in preventing a large amount of fuel vapor from being purged into the intake passage 1*a*.

When the second condition (i) or (iii) of the tenth embodiment is established, the three way valve 150 is controlled to connect the fuel vapor passage 18 to the second fuel vapor guide 158', to thereby introduce fuel vapor into the fuel vapor diffusion chamber 3. This results in reducing a deterioration of the adsorbing layer 4'.

Figure 18:
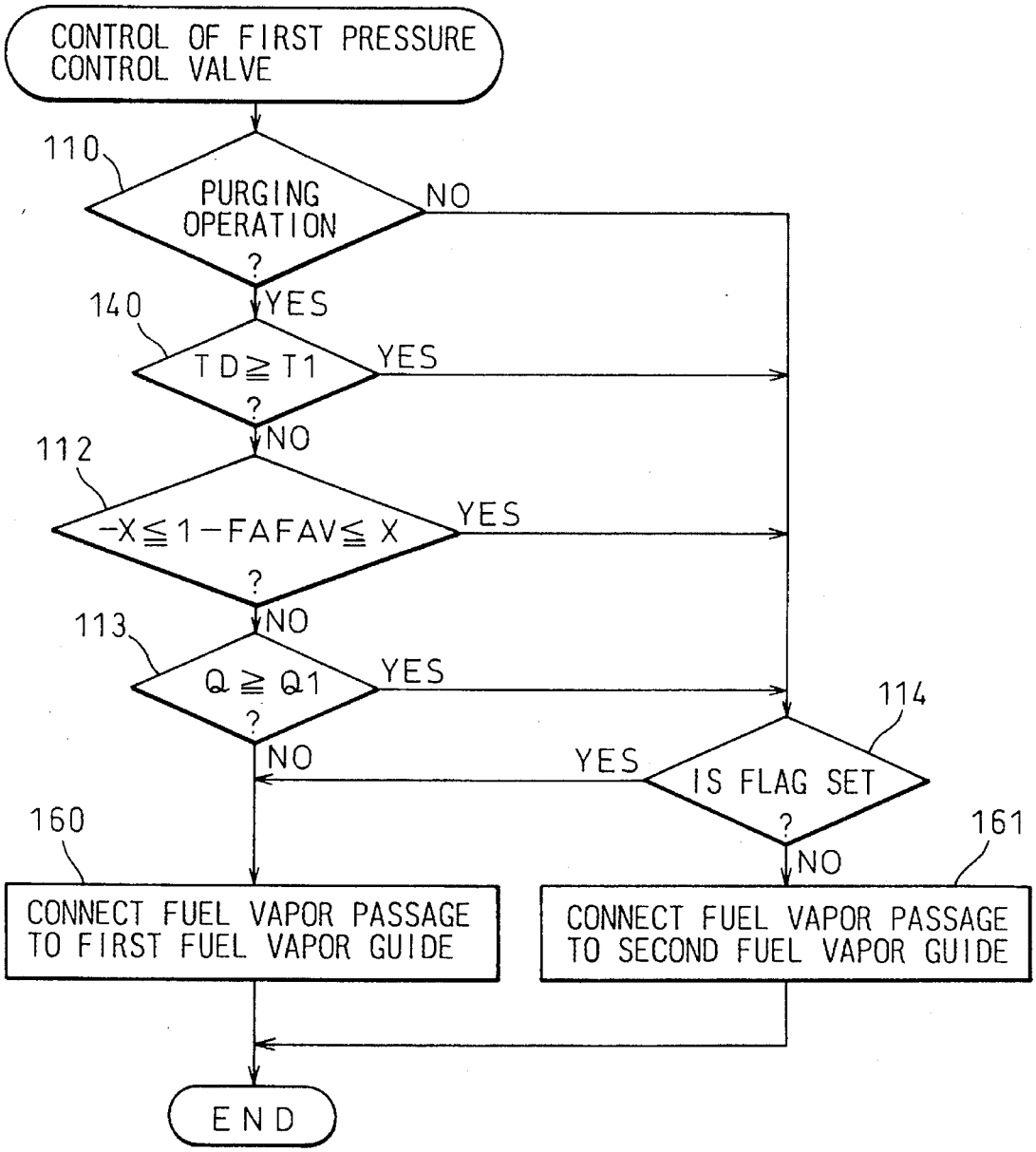
FIG. 18 is a flowchart for executing control of the first pressure control valve, according to the eleventh embodiment of the present invention.

A routine for executing the eleventh embodiment will be explained with reference to FIG. 18. This routine includes the same steps as those of the routines of FIGS. 11 and 16. These steps are represented with same reference numerals, and the explanations thereof will be omitted.

If Q<Q1 in step 113, or if the flag controlled by the routine shown in FIG. 10 is set in step 114, the routine goes to step 160, where the three way valve 150 is controlled to connect the fuel vapor passage 18 to the first fuel vapor guide 158. If the flag is reset in step 114, the routine goes to step 161, where the three way valve 150 is controlled to connect the fuel vapor passage 18 to the second fuel vapor guide 158'.

The pressure control valve 151 is kept closed until the pressure in the fuel tank 16 increases up to the valve opening pressure set by a spring 151*c*. Accordingly, the pressure in the fuel tank 16 can increase up to the valve opening pressure of the pressure control valve 151. Therefore, the pressure in the fuel tank 16 can increase to the saturation fuel vapor pressure in the fuel, and thus, the generation of fuel vapor is suppressed.

The three way valve 150 of the eleventh embodiment selectively connects the fuel vapor passage 18 to one of the first and second fuel vapor guides 158 and 158'. Alternatively, the three way valve 150 may be a duty control valve that connects the fuel vapor passage 18 to the first fuel vapor guide 158 for a period corresponding to a duty ratio in a duty cycle time and to the second fuel vapor guide 158' for the remainder. In this case, the duty ratio DUTY for the embodiments of FIGS. 12 and 14 may be employed as the duty ratio of the three way valve 150.

The fuel emission control device according to any one of the embodiments of FIGS. 9 to 18 is applied to an engine that temporarily stops fuel injection and purging operation according to an engine speed N when the engine is decelerated. The device of the present invention is also applicable to an engine that temporarily stops fuel injection to prevent an engine speed N from further increasing if the engine speed N is excessively high. On the other hand, if fuel is injected when a target amount of fuel to be injected is very small, the actual amount of fuel injected from the fuel injector may easily deviate from the target amount. Accordingly, there is an engine that temporarily stops fuel injection when the target amount of fuel is very small. The device of the present invention is applicable to this kind of engine.

According to the present invention, it is possible to reduce the deterioration of the adsorbent, while preventing the air-fuel ratio from widely fluctuating during the purging operation.

While the invention has been described by reference to specific embodiments chosen for purposes of illustration, it should be apparent that numerous modifications could be made thereto by those skilled in the art without departing from the basic concept and scope of the invention.

I claim:

1. A fuel vapor emission control device for an engine having a fuel tank and an intake passage with a throttle valve, the device comprising:

an adsorbent for temporarily adsorbing fuel vapor therein, the adsorbent being housed in a canister;

a fuel vapor passage connecting the fuel tank to the canister for introducing fuel vapor in the fuel tank into the canister;

a purge passage connecting the canister to the intake passage downstream of the throttle valve for purging fuel vapor from the canister into the intake passage;

purge control means for controlling a purging operation in which fuel vapor in the canister is purged into the intake passage via the purge passage; and effective volume control means for controlling an effective volume of the adsorbent interposed between the fuel vapor passage and the purge passage, during the purging operation, wherein the effective volume control means changes the effective volume of the adsorbent to become larger when an amount of fuel vapor to be introduced from the fuel tank to the canister becomes larger.

2. A device according to claim 1, wherein the effective volume control means changes the effective volume of the adsorbent to a first selected volume when the amount of fuel vapor to be introduced from the fuel tank to the canister is larger than a first predetermined amount, and to a second selected volume, which is smaller than first selected volume, when the amount of fuel vapor to be introduced from the fuel tank is smaller than the first predetermined amount.

3. A device according to claim 2, the effective volume control means comprising first and second introducing passages for introducing fuel vapor flowing through the fuel vapor passage, each of which having an outlet, wherein the outlet of the first introducing passage is arranged so that the volume of the adsorbent interposed between the outlet of the first introducing passage and the purge passage substantially equals the first selected volume, wherein the outlet of the second introducing passage is arranged so that the volume of the adsorbent interposed between the outlet of the second introducing passage and the purge passage substantially equals the second selected volume, and wherein the effective volume control means introduces fuel vapor flowing through the fuel vapor passage to the first introducing passage when the amount of fuel vapor to be introduced from the fuel tank is larger than the first predetermined amount, and to the second introducing passage when the amount of fuel vapor to be introduced from the fuel tank is smaller than the first predetermined amount.

4. A device according to claim 3, the device further comprising a fuel vapor chamber, to which the fuel vapor passage and the first and the second introducing passages are connected, and the effective volume control means further comprising a first fuel vapor control valve arranged in the first introducing passage, wherein the first fuel vapor control valve is open when the amount of fuel vapor to be introduced from the fuel tank is larger than the first predetermined amount, to thereby introduce fuel vapor in the fuel vapor chamber into the first introducing passage, and is closed when the amount of fuel vapor to be introduced from the fuel tank is smaller than the first predetermined amount, to thereby introduce fuel vapor in the fuel vapor chamber into the second introducing passage.

5. A device according to claim 4, wherein the first fuel vapor control valve has a valve element integrally connected to a diaphragm defining the fuel vapor chamber, the diaphragm deforming in response to an increment of a pressure in the fuel vapor chamber, and wherein the valve element is abutted against the end of the first introducing passage to close the first introducing passage when the pressure in the fuel vapor chamber is lower than a valve opening pressure of the first fuel vapor control valve, and is detached from the end of the first introducing passage to open the first introducing passage when the pressure in the fuel vapor chamber reaches the valve opening pressure, the valve opening pressure being a pressure when the amount of fuel vapor to be introduced from the fuel tank substantially equals the first predetermined amount.

6. A device according to claim 4, wherein the first fuel vapor control valve comprises a check valve arranged at the outlet of the first introducing passage, the check valve allowing a gas flow only from the fuel vapor chamber to the adsorbent, and wherein the check valve is closed when a difference between a pressure in the fuel vapor chamber and that in the adsorbent is lower than a valve opening pressure of the check valve, and is opened when the pressure difference reaches the valve opening pressure of the check valve, the valve opening pressure of the check valve being a pressure difference between a pressure in the fuel vapor chamber and that in the adsorbent when the amount of fuel vapor to be introduced from the fuel tank substantially equals the first predetermined amount.

7. A device according to claim 4, wherein the effective volume control means further comprises reducing means for reducing an amount of fuel vapor flowing through the second introducing passage when fuel vapor in the fuel vapor chamber is to be introduced into the first introducing passage.

8. A device according to claim 7, wherein the fuel vapor chamber comprises first and second fuel vapor chambers connected to each other, the first fuel vapor chamber being connected to the first introducing passage and the fuel vapor passage, and the second fuel vapor chamber being connected to the second introducing passage, and wherein the reducing means comprises a choke between the first and the second fuel vapor chambers.

9. A device according to claim 7, wherein the reducing means comprises a valve arranged in the second introducing passage, the valve being open when fuel vapor in the fuel vapor chamber is to be introduced into the second introducing passage, and being closed when fuel vapor in the fuel vapor chamber is to be introduced into the first introducing passage.

10. A device according to claim 3, wherein the device further comprises a valve arranged in the second introducing passage, the valve being closed when the amount of fuel vapor to be introduced from the fuel tank is smaller than a second predetermined amount which is smaller than the first predetermined amount, to thereby prevent fuel vapor flowing through the second introducing passage, and being opened when the amount of fuel vapor to be introduced from the fuel tank is larger than the second predetermined amount, to thereby allow fuel vapor flowing into the canister.

11. A device according to claim 3, wherein the outlet of the first introducing passage is arranged in a substantially central position of the adsorbent, and wherein, on one side of the outlet of the first introducing passage, the outlet of the second introducing passage is arranged in the canister, and, on another side of the outlet of the first introducing passage, the purge passage is connected to the canister.

12. A device according to claim 2, the effective volume control means further comprising a stationary and movable pipes telescopically connected to each other, the stationary pipe having first and second outlet, the first outlet being arranged so that the volume of the adsorbent interposed between the first outlet and the purge passage substantially equals the first selected volume, and the second outlet being arranged on a peripheral wall of the stationary pipe so that the volume of the adsorbent interposed between the second outlet and the purge passage substantially equals the second selected volume, the movably pipe supported by a diaphragm deformable in response to an increment of the amount of fuel vapor introduced from the fuel tank to move integrally therewith, wherein the movable pipe communicates the outlet thereof with the second outlet of the stationary pipe to flow fuel vapor through the second outlet of the stationary tube when the amount of fuel vapor is smaller than the first predetermined amount, and closes the second outlet of the stationary pipe by a wall thereof to pass fuel vapor through the first outlet of the stationary pipe when the amount of fuel vapor is larger than the first predetermined amount.

13. A device according to claim 2, wherein the first selected volume is substantially half of the total volume of the adsorbent.

14. A device according to claim 2, wherein the second selected volume is substantially zero.

15. A device according to claim 2, wherein the effective volume control means changes the effective volume of the adsorbent to a third selected volume, which is larger than the first selected volume, when the amount of fuel vapor to be introduced from the fuel tank is larger than a third predetermined amount, which is larger than first predetermined amount.

16. A device according to claim 15, wherein the first selected volume is substantially one third of the total volume of the adsorbent, the second selected volume is substantially zero, and the third selected volume is substantially half of the total volume of the adsorbent.

17. A device according to claim 1, wherein a fuel vapor control valve is provided between the adsorbent and the fuel tank, a valve opening pressure of the fuel vapor control valve being variable, wherein the opening pressure of the fuel vapor control valve becomes higher when the amount of fuel vapor to be introduced from the fuel tank becomes larger.

18. A device according to claim 17, wherein the fuel vapor control valve comprises a back pressure chamber, the valve opening pressure of the fuel vapor control valve becoming higher when a pressure in the back pressure chamber becomes higher, and wherein the back pressure chamber is connected to the fuel vapor passage.

19. A device according to claim 1, the engine further having air amount detecting means for detecting an amount of air fed into the engine, wherein the effective volume control means changes the effective volume of the adsorbent to become smaller when the amount of air detected by the air amount detecting means becomes larger.

20. A device according to claim 19, wherein the effective volume control means changes the effective volume of the adsorbent to a fourth selected volume when the amount of air is smaller than a predetermined air amount, and to a fifth selected volume, which is smaller than the fourth selected volume, when the amount of air is larger than the predetermined air amount.

21. A device according to claim 1, the engine further having a deviation detecting means for detecting a deviation in an air-fuel ratio of an air-fuel mixture, fed to the engine from a target ratio thereof, wherein the effective volume control means changes the effective volume of the adsorbent to become smaller when the deviation in the air-fuel ratio becomes smaller.

22. A device according to claim 21, wherein the effective volume control means changes the effective volume of the adsorbent to a sixth selected volume when the deviation in the air-fuel ratio is out of a predetermined range, and to a seventh selected volume, which is smaller than the sixth selected volume, when the deviation in the air-fuel ratio is within the predetermined range.

23. A device according to claim 1, the engine further having fuel feeding means for feeding pressurized fuel to the engine, and fuel feeding control means for controlling the fuel feeding operation of the fuel feeding means in accordance with an engine operating condition, wherein the purge control means stops the purging operation when fuel feeding control means temporarily stops the fuel feeding operation, and wherein the effective volume of the adsorbent when the purging operation is stopped due to the stoppage of the fuel feeding operation is smaller than that when the purging operation is carried out.

24. A device according to claim 23, wherein the fuel feeding control means temporarily stops the fuel feeding operation when the engine is decelerated.

25. A device according to claim 1, the effective volume control means comprising third and fourth introducing passages for introducing fuel vapor from the fuel vapor passage, each of which having an outlet, wherein the outlet of the third introducing passage is arranged so that the volume of the adsorbent interposed between the outlet of the third introducing passage and the purge passage substantially equals an eighth selected volume, and the outlet of the fourth introducing passage is arranged so that the volume of the adsorbent interposed between the outlet of the fourth introducing passage and the purge passage substantially equals a ninth selected volume, which is smaller than the eighth selected volume, and wherein the amount of fuel vapor introduced into the third introducing passage is increased and the amount of fuel vapor introduced into the fourth introducing passage is reduced when the amount of fuel vapor to be introduced from the fuel tank is larger than a fourth predetermined amount.

26. A device according to claim 25, wherein the amount of fuel vapor introduced into the third introducing passage becomes smaller and the amount of fuel vapor introduced into the fourth introducing passage becomes larger when the amount of air fed to the engine becomes larger.

27. A device according to claim 1, the effective volume control device further comprising a pressure sensor for detecting a pressure representing the amount of fuel vapor to be introduced from the fuel tank to the adsorbent, wherein the effective volume control means changes the effective volume of the adsorbent to become larger when the pressure detected by the pressure sensor becomes larger.

28. A device according to claim 27, wherein the pressure sensor is arranged in the fuel vapor passage to detect a pressure therein.

29. A device according to claim 1, the effective volume control means further comprising purge period detecting means for detecting a period during which the purging operation is in process, wherein the effective volume control means determines that the amount of fuel vapor to be introduced from the fuel tank becomes smaller when the purge period becomes longer.

30. A device according to claim 29, wherein the effective volume control means changes the effective volume of the adsorbent to a tenth selected volume when the purge period is shorter than a predetermined period, and to an eleventh selected volume, which is smaller than the tenth selected volume, when the purge period is longer than the predetermined period.

31. A device according to claim 1, the device further comprising: a fuel vapor diffusion chamber on one side of the adsorbent connected to the purge passage; an air chamber on another side of the adsorbent connected to the atmosphere via an air-inlet; a fuel vapor chamber connected to the fuel vapor passage; a first introducing pipe having an outlet, the outlet being arranged in the adsorbent; a second introducing pipe connecting the fuel vapor chamber to the fuel diffusion chamber; and a fuel vapor control valve arranged in the first introducing pipe, the valve being closed when the amount of fuel vapor to be introduced from the fuel tank is smaller than a predetermined amount, to thereby introduce fuel vapor in the fuel vapor chamber to the fuel vapor diffusion chamber through the second introducing pipe, and opened when the amount of fuel vapor to be introduced from the fuel tank is larger than to predetermined amount, to thereby introduce fuel vapor in the fuel vapor chamber to the adsorbent through the first introducing pipe.

32. A device according to claim 31, wherein the device further comprises an additional adsorbent between the adsorbent and the air inlet.

33. A device according to claim 31, the device further comprising a purge control valve arranged in the purge passage, wherein the purge control means controls the purge control valve to open when the purging operation is to be carried out, and to close when the purging operation is to be stopped, and wherein the fuel vapor control valve is closed when the engine is stopped.

34. A device according to claim 1, wherein the adsorbent comprises an activated carbon layer.

* * * * *

UNITED STATES PATENT AND TRADEMARK OFFICE

CERTIFICATE OF CORRECTION

PATENT NO. : 5,562,083
DATED : October 8, 1996
INVENTOR(S) : Akinori OSANAI

It is certified that error appears in the above-indentified patent and that said Letters Patent is hereby corrected as shown below:

Column 1, line 63, delete the comma after "adsorbent".

Column 4, line 25, insert a comma after "gas".

Column 5, line 6, delete the comma after "excessive".

Column 5, line 62, insert --of-- after "regardless".

Column 6, line 6, delete the comma after "works".

Column 6, line 47, insert --such-- before "as".

Column 7, line 66, delete the comma after "low".

Column 8, line 17, change "chock" to --choke--.

Column 9, line 54, after "Namely," insert --most of-- and delete "most" at end of line.

Column 9, line 55, delete "of" at beginning of line.

Column 9, line 59, insert a comma after "increases".

Column 9, line 67, change "is" to --are--.

Column 10, line 47, insert --the-- before "fourth".

Column 11, line 50, change "becomes" to --become--.

UNITED STATES PATENT AND TRADEMARK OFFICE

CERTIFICATE OF CORRECTION

PATENT NO. : 5,562,083
DATED : October 8, 1996
INVENTOR(S) : Akinori OSANAI

It is certified that error appears in the above-indentified patent and that said Letters Patent is hereby corrected as shown below:

Column 13, line 3, delete the hyphen between "30" and "degrees".

Column 13, line 34, insert --sensor-- between "ratio" and "is".

Column 13, line 38, insert --sensor-- between "ratio" and "is".

Column 15, line 46, insert --the-- after "In".

Column 15, line 56, change "steps" to --step--.

Column 16, line 4, change "112," to --112;--.

Column 16, line 54, change "(PT>P1)," to --(PT<P1)--.

Column 18, line 27, change "is" to --are--.

Column 21, line 23, insert --the-- before "first".

Column 22, line 61, delete "a".

UNITED STATES PATENT AND TRADEMARK OFFICE

CERTIFICATE OF CORRECTION

PATENT NO. : 5,562,083

DATED : October 8, 1996

INVENTOR(S) : Akinori OSANAI

It is certified that error appears in the above-indentified patent and that said Letters Patent is hereby corrected as shown below:

Column 23, line 3, change "movably" to --movable--.

Column 23, line 25, insert --a-- before "first".

Column 25, line 14, change "to" to --a--.

Signed and Sealed this

Third Day of June, 1997

*Attest:*

*Attesting Officer*

Bruce Lehman

BRUCE LEHMAN

*Commissioner of Patents and Trademarks*